US006983935B2

(12) United States Patent
Kaminkow

(10) Patent No.: US 6,983,935 B2
(45) Date of Patent: Jan. 10, 2006

(54) GAMING DEVICE HAVING AN INTERACTIVE MATRIX GAME

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/160,601

(22) Filed: May 31, 2002

(65) Prior Publication Data

US 2003/0222401 A1 Dec. 4, 2003

(51) Int. Cl.
*A63B 71/00* (2006.01)

(52) U.S. Cl. ..... 273/139; 463/21

(58) Field of Classification Search ..... 273/292, 273/138.1, 138.2, 139, 143 R, 138.3, 118 R, 273/121 D, 123 A, 125 A, 144 A, 144 B, 273/138.4; 463/13, 16, 18, 20, 21–22, 26
See application file for complete search history.

(56) References Cited

U.S. PATENT DOCUMENTS

| | | | | |
|---|---|---|---|---|
| 2,545,644 | A | 3/1951 | Benton et al. | |
| 3,797,829 | A * | 3/1974 | Heller | 273/271 |
| 4,335,879 | A * | 6/1982 | Wiskur | 273/260 |
| 4,349,201 | A * | 9/1982 | Clark | 273/400 |
| 4,410,178 | A | 10/1983 | Partridge | |
| 4,448,419 | A | 5/1984 | Telnaes | |
| 4,582,324 | A | 4/1986 | Koza et al. | |
| 4,624,459 | A | 11/1986 | Kaufman | |
| 4,695,053 | A | 9/1987 | Vazquez, Jr. et al. | |
| 4,822,048 | A * | 4/1989 | Axup | 273/144 B |
| 4,991,848 | A | 2/1991 | Greenwood et al. | |
| 5,013,043 | A * | 5/1991 | Halliday | 273/258 |
| 5,014,988 | A * | 5/1991 | Mirando et al. | 273/125 A |
| 5,014,991 | A * | 5/1991 | Mirando et al. | 463/16 |
| 5,178,390 | A | 1/1993 | Okada | |
| 5,205,555 | A | 4/1993 | Hamano | |
| 5,226,653 | A | 7/1993 | Bil et al. | |
| 5,342,047 | A | 8/1994 | Heidel et al. | |
| 5,362,052 | A | 11/1994 | Kubatsch | |
| 5,380,007 | A | 1/1995 | Travis et al. | |
| 5,433,448 | A | 7/1995 | Raphael et al. | |
| 5,456,465 | A | 10/1995 | Durham | |

(Continued)

FOREIGN PATENT DOCUMENTS

EP 0874337 A1 10/1998

(Continued)

OTHER PUBLICATIONS

Killer List of Video Games (KLOV) website, Pop-A-Ball, 1988.□□klov.com.*

(Continued)

*Primary Examiner*—Jessica Harrison
*Assistant Examiner*—Alex F. R. P. Rada, II
(74) *Attorney, Agent, or Firm*—Bell, Boyd & Lloyd LLC

(57) ABSTRACT

A gaming device and method having a bonus game including a matrix defining a plurality of receptacles and a plurality of members that engage the receptacles. The object of the game is to obtain at least one winning combination of members in the receptacles of the matrix. The gaming device provides a number of activations to the player. The player may choose members to eject or displace from the receptacles after each activation. The player continues to select members to eject from the receptacles in the matrix until the player obtains one or more winning combinations of members in the receptacles or until there are no activations remaining. The player receives at least one award for each winning combination of members that occur in the receptacles in the matrix.

76 Claims, 14 Drawing Sheets

U.S. PATENT DOCUMENTS 5,490,670 A 2/1996 Hobert
5,524,888 A 6/1996 Heidel
5,536,016 A 7/1996 Thompson
5,542,669 A 8/1996 Charron et al.
5,560,603 A 10/1996 Seelig et al.
5,611,535 A 3/1997 Tiberio
5,613,681 A 3/1997 Allen
5,634,639 A * 6/1997 Tokito et al. ..... 273/123 R
5,711,525 A 1/1998 Breeding
5,762,552 A * 6/1998 Vuong et al. ..... 463/25
5,769,716 A 6/1998 Saffari et al.
5,772,509 A 6/1998 Weiss
5,775,692 A 7/1998 Watts et al.
5,788,573 A 8/1998 Baerlocher et al.
5,823,874 A 10/1998 Adams
5,833,536 A 11/1998 Davids et al.
5,833,538 A 11/1998 Weiss
5,848,932 A 12/1998 Adams
5,851,148 A 12/1998 Brune et al.
5,873,781 A 2/1999 Keane
5,882,261 A 3/1999 Adams
5,902,184 A 5/1999 Bennett et al.
5,911,418 A 6/1999 Adams
5,927,714 A * 7/1999 Kaplan ..... 273/143 R
5,947,820 A 9/1999 Morro et al.
5,951,397 A * 9/1999 Dickinson ..... 463/36
5,964,463 A 10/1999 Moore, Jr.
5,967,894 A 10/1999 Kinoshita et al.
5,980,384 A 11/1999 Barrie
5,984,781 A 11/1999 Sunaga
5,997,400 A 12/1999 Seelig et al.
5,997,401 A 12/1999 Crawford
6,004,207 A 12/1999 Wilson, Jr. et al.
6,015,346 A 1/2000 Bennett
6,019,369 A 2/2000 Nakagawa et al.
6,033,307 A 3/2000 Vancura
6,056,642 A 5/2000 Bennett
6,059,289 A 5/2000 Vancura
6,059,658 A 5/2000 Mangano et al.
6,062,980 A 5/2000 Luciano
6,089,976 A 7/2000 Schneider et al.
6,089,977 A 7/2000 Bennett
6,089,978 A 7/2000 Adams
6,093,102 A 7/2000 Bennett
6,102,798 A 8/2000 Bennett
6,120,031 A 9/2000 Adams
6,120,377 A 9/2000 McGinnis, Sr. et al.
6,126,541 A 10/2000 Fuchs
6,126,542 A 10/2000 Fier
6,142,873 A 11/2000 Weiss et al.
6,142,874 A 11/2000 Kodachi et al.
6,142,875 A 11/2000 Kodachi et al.
6,146,273 A 11/2000 Olsen
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,186,894 B1 2/2001 Mayeroff
6,190,254 B1 2/2001 Bennett
6,190,255 B1 2/2001 Thomas et al.
6,203,429 B1 3/2001 Demar et al.
6,210,279 B1 4/2001 Dickinson
6,213,876 B1 4/2001 Moore, Jr.
6,224,483 B1 5/2001 Mayeroff
6,231,442 B1 5/2001 Mayeroff
6,231,445 B1 5/2001 Acres
6,261,177 B1 7/2001 Bennett
6,270,411 B1 8/2001 Gura et al.
6,302,790 B1 10/2001 Brossard
6,305,686 B1 * 10/2001 Perrie et al. ..... 273/146
6,309,300 B1 10/2001 Glavich
6,328,649 B1 12/2001 Randall et al.
6,334,814 B1 * 1/2002 Adams ..... 463/20
6,336,860 B1 1/2002 Webb
6,375,187 B1 4/2002 Baerlocher
6,398,218 B1 6/2002 Vancura
6,413,160 B1 7/2002 Vancura
6,413,161 B1 7/2002 Baerlocher et al.
6,419,579 B1 7/2002 Bennett
6,435,511 B1 8/2002 Vancura et al.
6,439,995 B1 8/2002 Hughs-Baird et al.
6,461,241 B1 10/2002 Webb et al.
6,464,582 B1 10/2002 Baerlocher et al.
6,481,713 B2 11/2002 Perrie et al.
6,494,785 B1 12/2002 Gerrard et al.
6,506,118 B1 1/2003 Baerlocher et al.
6,514,141 B1 2/2003 Kaminkow et al.
6,514,144 B2 2/2003 Riendeau et al.
6,533,660 B2 3/2003 Seelig et al.
6,561,899 B2 5/2003 Vancura
6,569,015 B1 5/2003 Baerlocher et al.
6,575,830 B2 6/2003 Baerlocher et al.
6,585,591 B1 7/2003 Baerlocher et al.
6,595,854 B2 7/2003 Hughs-Baird et al.
6,599,192 B1 7/2003 Baerlocher et al.
6,620,045 B2 9/2003 Berman et al.
6,632,141 B2 10/2003 Webb et al.
6,648,754 B2 11/2003 Baerlocher et al.
6,659,864 B2 12/2003 McGahn et al.
6,692,355 B2 2/2004 Baerlocher et al.
2002/0045475 A1 4/2002 Glavich et al.
2002/0072402 A1 6/2002 Baerlocher
2002/0142822 A1 10/2002 Baerlocher et al.
2002/0151350 A1 10/2002 Baerlocher et al.
2002/0155883 A1 10/2002 Baerlocher
2002/0187827 A1 12/2002 Blankstein
2003/0013514 A1 1/2003 Cregan et al.
2003/0040355 A1 2/2003 Baerlocher
2003/0045248 A1 3/2003 Palmer et al.
2003/0045344 A1 3/2003 Webb et al.
2003/0064795 A1 4/2003 Baerlocher et al.

FOREIGN PATENT DOCUMENTS

EP 0926645 A2 6/1999
EP 0944030 A2 9/1999
EP 0945837 A2 9/1999
EP 0981119 A2 2/2000
EP 0984408 A2 3/2000
EP 0984409 A2 3/2000
GB 2226907 A 7/1990
JP 09019540 1/1997
WO WO 9732285 9/1997
WO WO 00/12186 3/2000

OTHER PUBLICATIONS

Killer List of Video Games (KLOV) website, Pop-A-Ball 2, 1990.□□klov.com.*
Data East, Hop-A-Tic-Tac-Toe, 1991.*
1DU Dice Mechanism written by Starpoint Electrics Ltd., published in Jul. 2000.
1DU Dice Unit Advertisement written by starpoint.uk.com, printed on May 14, 2001.
4DU Dice Unit Advertisement written by starpoint.uk.com, printed on Sep. 3, 2002.
Addams Family Advertisement and Article written by IGT, Strictly Slots, published in 2000.

Adders and Ladders Advertisement written by Barcrest Ltd., published prior to 2000.
American Thunder Screen Shots written by IGT, published in 1998.
Bally Slot Machines Electro-Mechanicals 1964-1980, Revised 3rd Edition written by Marshall Fey.
Big Bang Piggy Bankin Advertisement written by WMS Gaming, Inc., published prior to 2000.
Blackjack/Twenty-One Description written by Hoyle's Rules of Games, published in 1993.
Bonus Spin Red, White & Blue Advertisement written by IGT, published in 2000.
Bonus Times Article written by Strictly Slots, published in 2000.
By George written by IGT, published in 2002.
Caribbean Gold II Advertisement written by Aristocrat Incorporated, published in 1998.
Cash Box Advertisement & Article written by Anchor Games, Strictly Slots, published in 2000.
Chutes & Ladders Game Instructions written by Hasbro-Milton Bradley, published in 1999.
Description of Let's Make a Deal Television Show written by letsmakeadeal.com (2 pages), printed on Mar. 16, 2001.
Dice Games Article describing Poker Dice, published prior to 2001.
Double Diamond Game Descriptions written by IGT printed on Mar. 21, 2001.
Double Dice Advertisement written by JHV Gaming Products, undated, and English explanation from errel.com, printed on Jan. 24, 2003.
Double Up Poker Game Description written by IGT Undated.
Easy Street Advertisements and Articles written by Casino Data Systems, published in 2000.
Elvis Advertisement written by IGT, published in 1999.
Empire Game Advertisement written by AC Coin, published in 1996.
Field Testing New Slots Article, written by Strictly Slots, published in Jul. 2000.
Fire and Fortune Article written by Strictly Slots, published in 2001.
Fox "N" Hound Advertisement written by IGT, published in 2000.
Free! 7-Day Trial on Daval's Reel Dice Advertisement written by Gerber & Glass, published in 1936.
Game Devices Advertisement written by starpoint.uk.com, printed on Sep. 3, 2002.
How to Play—Roll & Win Instructions written by WMS Gaming, wmsgaming.com, printed on Aug. 29, 2001.
I Love Lucy Advertisement written by IGT, published in 2002.
In Between Game Description written by IGT, available prior to 2000.
Instant Slotto—Manufacturer A.C. Coin joins with Showboat Atlantic City in a unique promotion, Strictly Slots Magazine, Apr. 2001, pp. 70-72.
Jackpot Party Advertisements and Articles written by WMS Gaming, Inc., published in 1998.
Keep Your Hat On Advertisement written by Aristocrat, published in 2001.
Let's Make A Deal Advertisement written by Shuffle Master and IGT, published in 2001.
Let's Make a Deal Game Advertisement written by Bally Gaming Systems, published in 1999.
Let's Make a Deal geocities.com (2 pages), printed on Mar. 16, 2001.
Let's Make a Deal written by fortunecity.com (4 pages), printed on Mar. 21, 2001.
Let's Make a Deal written by geocities.com (10 pages), printed on Mar. 21, 2001.
Let's Make a Deal written by Illinoislottery.com (1 page), printed on Mar. 21, 2001.
Levy Patent Abstract written by Derwent Publications Ltd., published in 1991.
Little Green Men Advertisement and Article written by IGT, Strictly Slots, published in 2000.
MegaJackpots Advertisement written by IGT, published in 1998.
Mikohn Solutions, World Gaming Congress 2000 Edition.
Money Grab Advertisement written by WMS Gaming, Inc., wmsgaming.com, printed on Jan. 30, 2003.
Money Grab Article written by Strictly Slots, published in Apr. 2001.
Money in the Bank Advertisement written by Strictly Slots Konami, published in 2001.
Monopoly Advertisements and Articles written by WMS Gaming, Inc., Strictly Slots, published in 1998, 1999, 2000.
Monopoly Party Train Article written by Strictly Slots, published Feb. 2002.
Neon Nights written by IGT, published in 2000.
New Kids Article written by Strictly Slots, published in Dec. 2000.
On the Money Article written by Strictly Slots, Casino Data Systems, published in Dec. 2000.
Polly & Roger Advertisement written by VLC, Inc., published in 2000.
Price is Right "Cliff Hangers" Description written by www.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
Roll & Win Advertisement written by WMS Gaming, wmsgaming.com, printed Jun. 8, 2001.
Slot Machine Buyer's Handbook, A Consumer's Guide to Slot Machines written by David L. Saul and Daniel R. Mead, published 1998.
Slot Machines A Pictorial History of the First 100 Years, 5th edition, written by Marshall Fey, published 1983 to 1997.
Slot Machines On Parade written by Robert N. Geddes and illustrated by Daniel R. Mead, published 1980.
South Park—Dodgeball Advertisement written by IGT, published in 2000.
Spam Article written by IGT, published in 2002.
Spell Binder Advertisement written by IGT, published in 2000.
Sphinx Advertisement written by Atronic Casino Technology, Ltd., published in 1997.
Starpoint 1DU Dice Unit Product Summary written by Starpoint Electrics Ltd, published in Dec. 1999.
Starpoint 4DU Game Device Product Summary written by Starpoint Electrics Ltd.
Stars, Bars and Bones Game P&M Coins, Inc. available 1997.

Take Your Pick Advertisement written by IGT/Anchor Gaming, published in 1999.
Take Your Pick Article written by Strictly Slots, published in Mar. 2001.
Texas Tea Advertisement written by IGT, published in 2000.
The Deals of Let's Make a Deal written by fortunecity.com (2 pages), printed on Mar. 16, 2001.
The Official Let's Make a Deal Website written by Bally Gaming System Website, printed on Mar. 16, 2001.
Tic Tac Dough Advertisement, The Unofficial Tic Tac Dough Supersite, angelfire.com.
Tic Tac Toe, exploratorium.edu.
Top Cat Advertisement written by WMS Gaming, Inc., published prior to 2000.
Top Dollar Game Advertisement written by IGT, published in 1998.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel Poker Article written by Strictly Slots (Anchor Games), published in Nov. 2000.
Winning Streak Web Site Description written by WMS Gaming Inc. (web site), printed on Mar. 21, 2001.
X Factor Advertisement and Website Page written by WMS Gaming, Inc., published in 1998.
Yahtzee Bonus Advertisement, written by Mikohn Winning Solutions Worldwide, published 1999.
Yahtzee Video Game Advertisement, written by Mikohn Winning Solutions Worldwide, published 1999.
A Vamp for All Seasons Article, written by Strictly Slots, published in 2002.
American Bandstand Article, written by Strictly Slots, published in 2002.
Cash for Life—Offer Bonus Advertisement/Lotsa Loot Advertisement/Take It or Leave It Advertisement, written by Bally Gaming, published in 2002.
Cash for Life—Triple Spin Bonus Article, written by Strictly Slots, published in 2003.
Deep Pockets Advertisement, written by IGT, published in 2002.
Deep Pockets Article, written by Strictly Slots, published in 2002.
Double Top Dollar Advertisement, written by IGT, published in 2003.
Hollywood Advertisement, written by Shuffle Master Gaming, published in 2001.
King Cash Slots Advertisement, written by IGT, published in 2003.
Press Your Luck Advertisement, written by Shuffle Master Gaming, published in 2000.
Press Your Luck Article, written by Strictly Slots, published in 2000.
Price is Right—Cliff Hangers Advertisement, written by IGT, published in 2001.
Three Wishes Article, written by Strictly Slots, published in 2000.

* cited by examiner

GAMING DEVICE HAVING AN INTERACTIVE MATRIX GAME

CROSS REFERENCE TO RELATED APPLICATIONS

This application relates to the following commonly owned patent applications: "GAMING DEVICE HAVING SEPARATELY CHANGEABLE VALUE AND MODIFIER BONUS SCHEME," Ser. No. 09/626,045; "GAMING DEVICE HAVING A BONUS ROUND WITH MULTIPLE RANDOM AWARD GENERATION AND MULTIPLE RETURN/RISK SCENARIOS," Ser. No. 09/678,989; "GAMING DEVICE HAVING AN AWARD EXCHANGE BONUS ROUND AND METHOD FOR REVEALING AWARD EXCHANGE POSSIBILITIES," Ser. No. 09/689,510; "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601; "GAMING DEVICE HAVING A DESTINATION PURSUIT BONUS SCHEME WITH ADVANCED AND SETBACK CONDITIONS," Ser. No. 09/686,409; "GAMING DEVICE HAVING VALUE SELECTION BONUS," Ser. No. 09/684,605; "GAMING DEVICE HAVING RISK EVALUATION BONUS ROUND," Ser. No. 09/688,434; "GAMING DEVICE HAVING AN IMPROVED OFFER ACCEPTANCE BONUS SCHEME," Ser. No. 09/966,884; "GAMING DEVICE HAVING IMPROVED OFFER AND ACCEPTANCE BONUS SCHEME," Ser. No. 09/680,630; "GAMING DEVICE HAVING IMPROVED AWARD OFFER BONUS SCHEME," Ser. No. 09/682,368; "GAMING DEVICE HAVING OFFER AND ACCEPTANCE GAME WITH HIDDEN OFFER," Ser. No. 10/160,688; "GAMING DEVICE HAVING OFFER ACCEPTANCE GAME WITH TERMINATION LIMIT," Ser. No. 09/822,711; "GAMING DEVICE HAVING OFFER/ACCEPTANCE ADVANCE THRESHOLD AND LIMIT BONUS SCHEME," Ser. No. 09/838,014; "GAMING DEVICE HAVING IMPROVED OFFER AND ACCEPTANCE GAME WITH MASKED OFFERS," Ser. No. 10/086,014; "GAMING DEVICE HAVING AN OFFER AND ACCEPTANCE SELECTION BONUS SCHEME WITH A TERMINATOR AND AN ANTI-TERMINATOR," Ser. No. 09/945,082; "GAMING DEVICE HAVING AN AWARD OFFER AND TERMINATION BONUS SCHEME," Ser. No. 09/682,428; "GAMING DEVICE HAVING AN OFFER AND ACCEPTANCE GAME WITH A PLAYER SELECTION FEATURE," Ser. No. 10/086,078; "GAMING DEVICE HAVING OFFER AND ACCEPTANCE GAME WITH A PLURALITY OF AWARD POOLS, A REVEAL FEATURE, AND A MODIFY FEATURE," Ser. No. 10/255,862; "GAMING DEVICE HAVING IMPROVED OFFER AND ACCEPTANCE BONUS SCHEME," Ser. No. 10/074,273; "GAMING DEVICE HAVING AN OFFER/ACCEPTANCE GAME WITH MULTI-OFFER SYMBOL," Ser. No. 10/245,387; "GAMING DEVICE HAVING AN OFFER/ACCEPTANCE GAME WHEREIN EACH OFFER IS BASED ON A PLURALITY OF INDEPENDENTLY GENERATED EVENTS," Ser. No. 10/244,134; "GAMING DEVICE HAVING A DESTINATION PURSUIT BONUS SCHEME WITH ADVANCED AND SETBACK CONDITIONS," Ser. No. 10/288,750; "GAMING DEVICE HAVING IMPROVED AWARD OFFER BONUS SCHEME," Ser. No. 10/290,800; "GAMING DEVICE HAVING VALUE SELECTION BONUS," Ser. No. 10/306,295; "GAMING DEVICE HAVING IMPROVED AWARD OFFER BONUS SCHEME," Ser. No. 10/318,752; "GAMING DEVICE HAVING VALUE SELECTION BONUS," Ser. No. 10/354,514.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device having a bonus game, and more particularly to a gaming device having an interactive matrix bonus game.

Games have provided hours of excitement and enjoyment to people for many years. As a result, games have become a significant form of entertainment in society. One game that has provided entertainment to people is Tic Tac Toe.

Tic Tac Toe generally involves two people competing against each other to complete the game. However, in some versions of the game, a player may play against a computer. The game generally includes a three by three grid and two different symbols such as an "X" and an "O." Each player chooses one of the symbols, either the "X" or the "O." One of the players goes first and places one of their symbols in one of the squares in the three by three grid. Then, the other player places one of their symbols in the grid. The players alternate turns until one of the players has three of their symbols aligned horizontally, vertically or along a diagonal in the grid. In some games, neither player is able to align three of their symbols in a row, vertically or along a diagonal. In these situations, the game ends in a tie. Because Tic Tac Toe is a very popular game, it continues to provide excitement and enjoyment to game players all over the world.

Similarly, gaming devices such as casino games are also a very popular form of entertainment. There are a wide variety of gaming devices in the gaming and entertainment industry. Some gaming devices incorporate mechanical devices, such as reels having various symbols, and provide an award to a player when certain results are achieved on such devices. Other gaming devices incorporate video screens in combination with the mechanical devices to increase the players' enjoyment of the games.

One gaming device, U.S. Pat. No. 5,927,714, discloses an interactive Tic-Tac-Toe slot machine. In this patent, the slot machine includes three parallel reels having two different configurations, such as an "X" and an "O." A blank symbol is also included on the reels. A player spins the reels to obtain a winning combination on the reels. A winning combination on the reels includes three symbols aligned horizontally, vertically or diagonally on the reels. Furthermore, the slot machine can be played with one to eight coins. The amount of coins inputted by the player determines the possible winning combinations available to the player in the game. The player receives the maximum number of possible winning combinations in the game if the player wagers the maximum number of coins.

It should be appreciated that providing new gaming devices that incorporate physical aspects into games, increases player excitement and enjoyment. Players enjoy playing games that the player can physically see, touch and hear. Thus, it is desirable to provide new gaming devices that include physical aspects and components in games.

SUMMARY OF THE INVENTION

The present invention relates in general to a gaming device having an interactive matrix game, and more particularly to a gaming device having an interactive matrix game including a housing and a matrix defining a plurality of receptacles positioned inside the housing. In one embodiment, the matrix is a M by N matrix, where M equals the number of rows and N equals the number of columns in the matrix. In alternative embodiments, the matrix may include other arrangements of the receptacles such as in a circle, any other suitable pattern or any random or scattered arrangement. It should thus be appreciated that the matrix of receptacles of the present invention can include one or more receptacles in any suitable positions.

The housing may be permanently attached to the cabinet of the gaming device or a separate component. A plurality of members are adapted to engage or fit into the receptacles in the matrix. In one embodiment, the members include a plurality of first members and a plurality of second members which have different characteristics. In one embodiment, the first members include a first characteristic such as an "X" and the second members include a second characteristic such as an "O." It should be appreciated that any suitable distinguishing characteristics may be employed in accordance with the present invention.

The player's goal is to obtain one or more winning combinations of first and/or second members in the receptacles of the matrix. The winning combinations may be any combination of first and/or second members desired by the game implementor. The gaming device provides a player with a predetermined number of activations or ejections at the beginning of the bonus game. Then, the gaming device ejects or displaces all of the first and second members from the receptacles in the matrix. The first and second members re-engage the receptacles in the matrix. It should be appreciated that the first and second members may or may not re-engage the same receptacles that the members were engaged in prior to being ejected from the matrix.

In one embodiment, the gaming device ejects the first and second members from the receptacles in the matrix for a number of activations or ejections. The player receives the award or awards associated with the winning combinations. The gaming device continues to eject or displace the first and second members from the receptacles until one or more combinations of first and/or second members occurs in the receptacles or until there are no further activations or ejections remaining in the bonus game.

In another embodiment, the gaming device enables the player to independently select first and second members to eject from the matrix for a number of activations or ejections. The gaming device then ejects or displaces the selected first and second members from the receptacles in the matrix. The first and second members re-engage the receptacles and the gaming device determines if one or more winning combinations occur in the receptacles. The player continues to select first and second members to eject from the receptacles in each activation or ejection until the player obtains one or more winning combinations or until there are no activations or ejections remaining. In an alternative embodiment, the gaming device enables the player to independently select and hold first and second members in the receptacles in the matrix.

In a further embodiment, the gaming device enables the player to choose or decide if the player wants to keep a particular winning combination or combinations in each activation or ejection. If the player does not want to keep a particular winning combination, the gaming device enables the player to select first and second members to eject from the matrix. The player continues to select and eject first and second members from the receptacles in the matrix until the player obtains one or more winning combinations or until there are no activations or ejections remaining in the game.

An ejector is associated with each receptacle in the matrix. In one embodiment, the ejectors are air-type ejectors such as air blowers, that direct air against the first and second members to force the members out of their respective receptacles in the matrix. In another embodiment, the ejectors are mechanical devices such as solenoids or actuators that trigger a component to contact the first and second members and eject the members from the receptacles in the matrix. In the above embodiments, intermediate ejectors may be connected and positioned to areas in the matrix where a ball is likely to get stuck such as between one or more receptacles or along the edges of the matrix. Additionally, the matrix may be molded so that the areas between the receptacles and along the edges of the receptacles are angled so that the balls move towards open receptacles. It should be appreciated that any suitable type of ejector may used to eject the members from the matrix.

In one embodiment, one or more sensors are connected to, positioned in or adjacent to each receptacle in the matrix. The sensors detect the type (i.e., whether a particular ball is a first or second member) and the location of the first or second members in the matrix. In one embodiment, the sensors are magnetic sensors which detect different types of magnetic materials inside the first and second members. In another embodiment, the sensors are weight sensors, which detect the difference in weight between the first and second members. Using a control device in communication with the processor, the player chooses which members the player wants to eject from the matrix. Then, the control device communicates with the processor, which activates the ejectors to eject or displace the selected first and second members from the receptacles in the matrix.

In an alternative embodiment, the first and second members are engaged in a plurality of first receptacles in a holding device that is connected inside the top of the housing. The gaming device enables a player to independently select and release the first and second members from the first receptacles. The released first and second members engage a plurality of second receptacles in a matrix, which is connected inside the bottom of the housing. The player continues to select and release first and second members from the first receptacles until the player obtains one or more winning combinations or until all of the first and second members are released from the first receptacles.

In one embodiment, the gaming device includes a passageway, tube or other communication mechanism suitably adapted to direct the member into the housing at or from one or more predetermined or common locations. In this embodiment, all of the members can be stored in such location(s) until use or deployment.

If the player did not obtain at least one winning combination in the second receptacles after releasing all of the first and second members, the gaming device enables the player to independently select and displace the first and second members from the second receptacles in the matrix. The player continues to select and displace first and second members from the second receptacles in the matrix until the player obtains one or more winning combinations of first and/or second members or until there are no activations or ejections remaining in the game. The player receives an award or awards based on a the number and type of winning combinations that occur in the second receptacles in the matrix.

It should be appreciated that the present invention could be employed as a primary game or a bonus game in a gaming device.

It is therefore an advantage of the present invention to provide a gaming device having a player interactive matrix.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
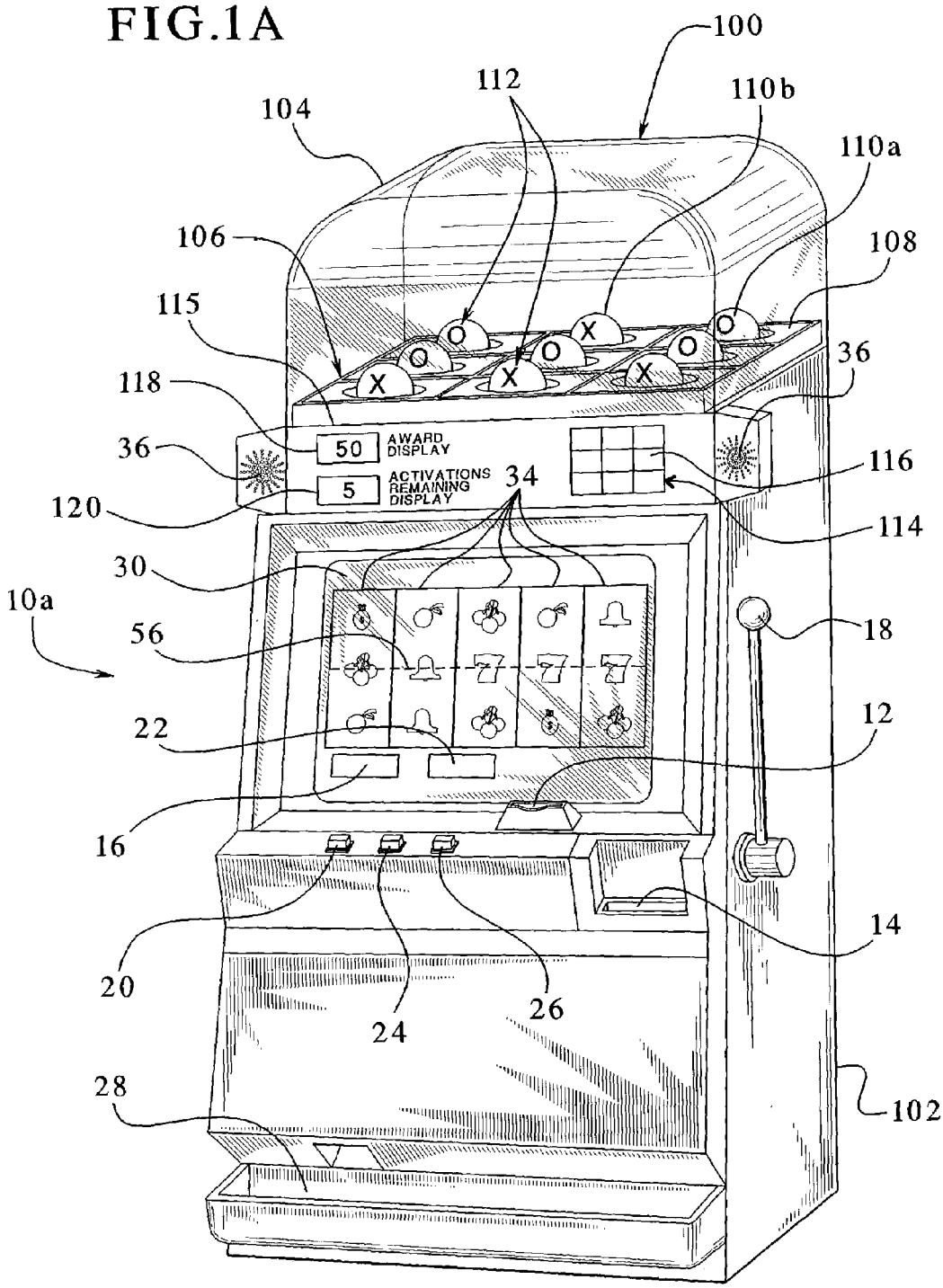
FIG. 1A is front perspective view of one embodiment of the gaming device of the present invention.
Figure 1B:
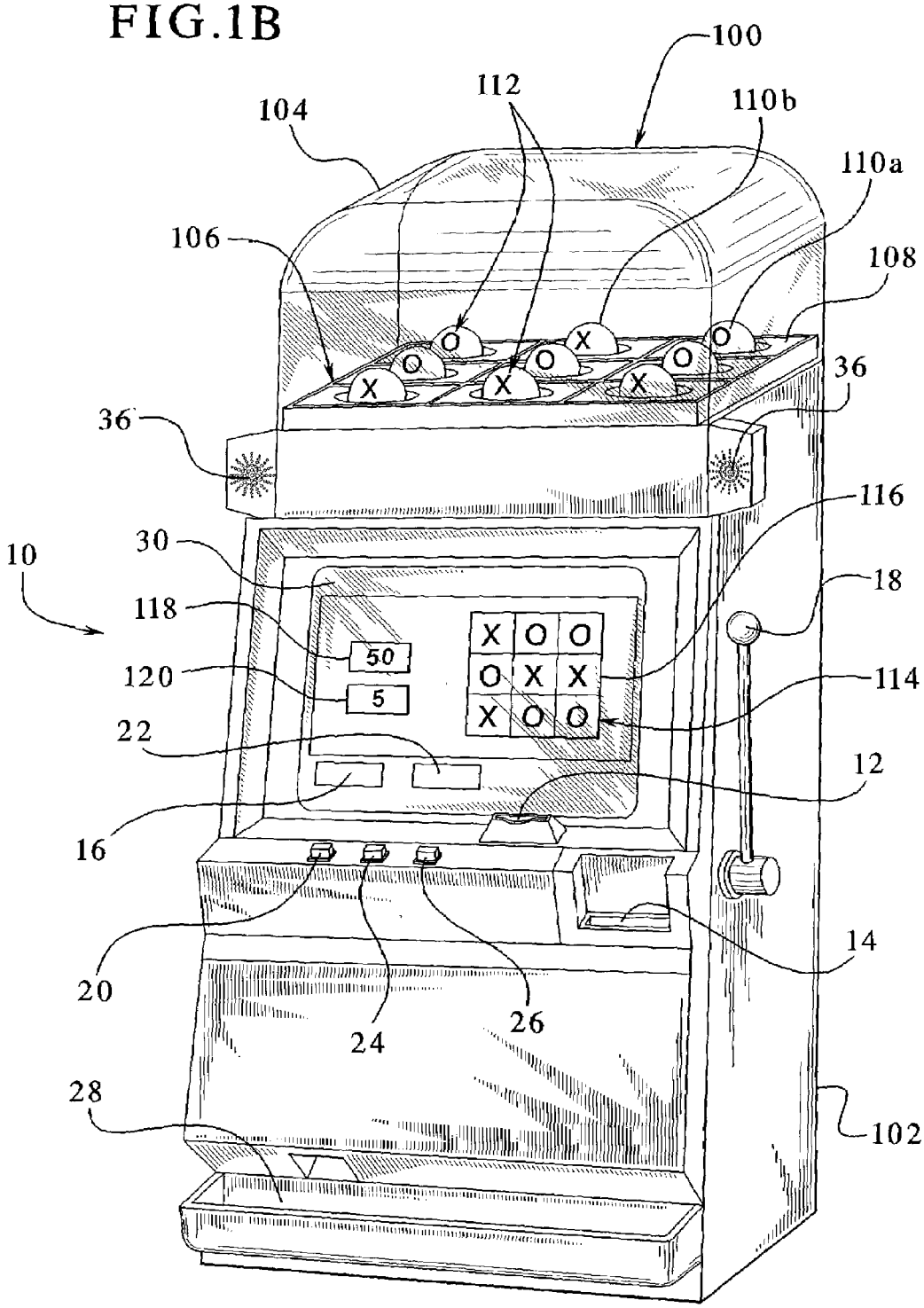
FIG. 1B is front perspective view of another embodiment of the gaming device of the present invention.

Referring now to the drawings, two embodiments of the gaming device of the present invention are generally illustrated in FIGS. 1A and 1B as gaming device 10*a* and gaming device 10*b*, respectively. Gaming device 10*a* and/or gaming device 10*b* are generally referred to herein as gaming device 10. Gaming device 10 preferably has the controls, displays and features of a conventional gaming machine. It is constructed so that a player can operate it while standing or sifting, and gaming device 10 preferably includes a console or cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B.

Gaming device 10 can incorporate any primary game such as slot, poker, blackjack or keno, any of their bonus triggering events and any suitable bonus round game. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. The gaming device may include other wager indicators such as a bet max indicator.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 may also include one or more display devices. The embodiment shown in FIG. 1A includes a central display device 30, an intermediate display area 115 and interactive matrix display 100. The alternative embodiment shown in FIG. 1B includes a central display device 30 as well as interactive matrix display 100.

In a slot embodiment, gaming device 10 displays a plurality of reels 34 such as three to five reels 34 in mechanical or video form at one or more of the display devices. However, it should be appreciated that the display devices can display any visual representation or exhibition, including but not limited to movement of physical objects such as mechanical reels and wheels, interactive matrices such as the matrices illustrated in FIGS. 1A and 1B, dynamic lighting and video images. A display device can be any viewing surface such as glass, a video monitor or screen, a liquid crystal display or any other suitable display mechanism or apparatus. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
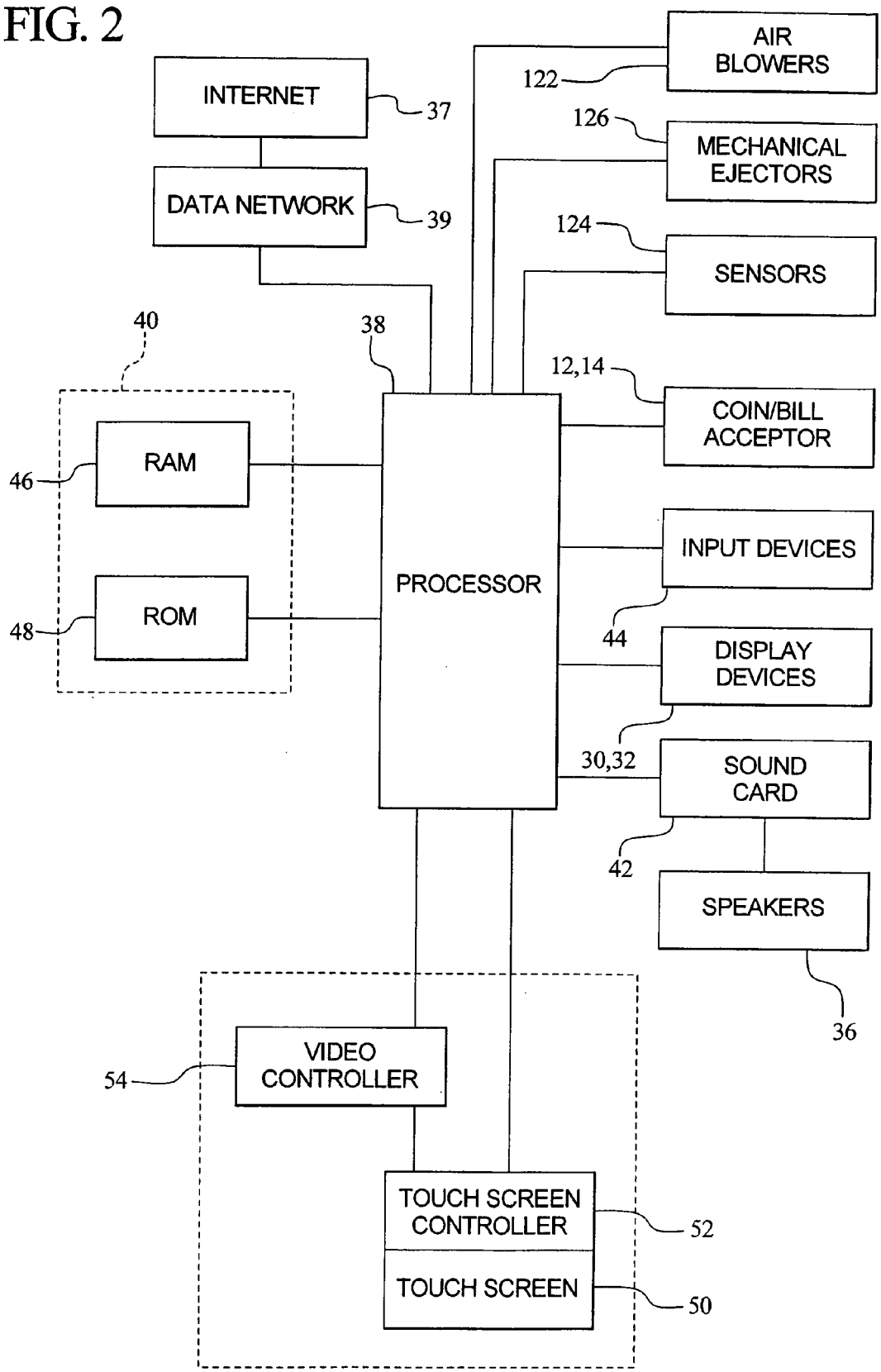
FIG. 2 is a schematic block diagram of the electronic combination of one embodiment of the gaming device of the present invention.

As illustrated in FIG. 2, the general electronic combination of gaming device 10 preferably includes: a processor 38; a memory device 40 for storing program code or other data; a central display device 30; a sound card 42; a plurality of speakers 36; sensors 124 for detecting the position of the first and second members; air blowers 122 or mechanical ejectors 126 such as actuators for displacing the first and second members from the matrix; and one or more input devices 44. The processor 38 is preferably a microprocessor or microcontroller-based platform which is capable of displaying images, symbols and other indicia such as images of people, characters, places, things and faces of cards. The processor can also include sub-processors or co-acting processors, which control the function of the gaming machine. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or alternatively referred to herein as a "processor") . Furthermore, although the processor 38 and memory device 40 preferably reside on each gaming device 10 unit, it is possible to provide some or all of their functions at a central location such as a network server for communication to a playing station such as over a local area network (LAN), wide area network (WAN), a data network 37 such as an Internet connection 39, microwave link, and the like. The processor 38 and memory device 40 is generally referred to herein as the "computer" or "controller".

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, in one embodiment of the present invention, gaming device 10 also gives players the opportunity to win credits in a bonus game. This type of gaming device 10 will include a program which will automatically begin a bonus game when the player has achieved a qualifying condition in the primary game. This qualifying condition can be a particular arrangement of indicia on a display device. The gaming device 10 preferably uses a video-based central display device 30 to enable the player to play the bonus round. In one embodiment, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Matrix Game

In one embodiment of the present invention, if a player achieves a bonus triggering or qualifying condition during the primary game, the gaming device 10 automatically initiates the bonus game of the present invention.

Referring to FIG. 1A, one embodiment of the present invention includes a gaming device 10 having an interactive matrix display 100 mounted on the top of cabinet 102. Preferably, an interactive matrix display includes a housing 104 that is permanently attached to the cabinet 102. However, it should be appreciated that the housing 104 may be a separate component removably attached to the cabinet 102 of gaming device 10. The housing 104 is preferably made of a transparent material that enables a player to see through at least a portion of the housing. The housing may be secured to the cabinet using suitable fasteners.

The housing 104 includes a matrix 106 that is positioned inside the housing and is connected to the cabinet 102 or the housing 104. The matrix 106 defines a plurality of receptacles 108. The receptacles 108 are positioned adjacent to each other within the matrix 106. In one embodiment, the matrix includes nine receptacles arranged in a three by three configuration as illustrated in FIG. 1A. It should be appreciated, however, that the matrix may include any number of receptacles that are arranged in any configuration desired by a game implementor.

A plurality of members are located inside housing 104 and manufactured to engage the receptacles 108 in the matrix. It should be appreciated that in an alternative embodiment, the members and the receptacles could be suitably sized such that only certain members can engage certain receptacles in the matrix. In one embodiment, the members include a plurality of first members and a plurality of second members that include different characteristics. In one embodiment, the first members include a first characteristic and the second members include a second characteristic wherein the first and second characteristics are different. It should be appreciated that two or more characteristics may be used and that the characteristics may be any characteristics desired by the game implementor. In the illustrated embodiment, the first and second members are first and second balls 110*a* and 110*b*. The first and second balls 110*a* and 110*b* include a first and second characteristic, respectively. Each ball 110*a* is associated with a first characteristic such as an "O" and each ball 110*b* is associated with a second characteristic such as "X." The characteristics 112 are on or affixed to the balls in a suitable manner. During a bonus game, the balls 110*a* and 110*b* are displaced or ejected from the receptacles by suitable ejectors or other devices as describe below. The receptacles in the matrix are formed such that each of the balls 110*a* and 110*b* will re-engage a receptacle 108 in the matrix 106 as further discussed below.

The player's goal is to obtain a winning combination or arrangement of members, such as first and second balls 110*a* and 110*b*, in the receptacles in matrix 106. In one embodiment, the first and second balls are automatically ejected from the receptacles in the matrix for a number of activations or ejections until one or more winning combinations of first and/or second balls occur in the receptacles in the matrix or until there are no activations or ejections remaining. The player receives at least one award associated with any winning combinations that occur in the matrix and the game ends.

In another embodiment discussed herein, the gaming device enables a player to select first and second balls to eject or displace from the receptacles in each turn or activation or ejection. The player interacts with the ejectors (not shown) associated with each of the receptacles 108 in matrix 106 by using a control device such as touch screen 114. While a touch screen 114 is preferred, it should be appreciated that any suitable control device may be used. In one embodiment, the touch screen 114 is divided into control sections 116 that correspond with the ejectors associated with the receptacles 108 in matrix 106.

After touching or pressing a control section 116 on touch screen 114, the control section is highlighted to show the receptacles that were selected by the player. By activating a control section 116, the player indicates to the processor that the player wants to eject a particular ball from its present receptacle in the matrix. The control device may be suitably illuminated to indicate to the player whether a control section has been selected by the player. If the player changes their mind, the player may activate, press or touch the highlighted control section again to deactivate that control section.

In one embodiment, the gaming device prompts the player to press a button such as an eject button (not shown) or touch a particular area of the display when the player is finished selecting first and second balls to eject from the matrix. It should be appreciated that any suitable prompt may be used to notify the player. In another embodiment, after the player is finished selecting the first and second balls to eject from the matrix, the player initiates the ejection or displacement of the first and second balls by either pressing play button 20, pulling arm 18 or by using some other device such as a separate play button (not shown) located on gaming device 10.

An award display 118 displays the value of the award or awards accumulated by the player in the bonus game. Once the game ends, the total award shown in display 118 will be transferred to the player's credit meter. An activations or ejections remaining display 120 indicates the number of activations, ejections or turns that a player has remaining in a game. The number indicated by the activations or ejections remaining display 120 preferably decreases by one after each activation or ejection. It is also contemplated that the number of activations or ejections indicated in activations remaining display 120 could start at zero and increase by one after each activation or ejection. In this illustration, there are five activations or ejections remaining as indicated by activations remaining display 120 in FIG. 1A. When the number of activations or ejections equals zero, the game ends.

Referring now to FIG. 1B, another embodiment of the present invention is illustrated where the control device is located on the main display device 30. A larger touch screen 114 is used to interact with the receptacles 108 in matrix 106. The touch screen 114 has control sections 116 that correspond to receptacles 108 in the matrix. The player touches the control sections to activate the control section and activate, displace or eject the first and/or second balls from the receptacles in the matrix. Similar to the touch screen in FIG. 1A, the control sections of the touch screen illuminate to indicate to the player that the player has selected that section and corresponding receptacle in the matrix. Once the player is finished, the player may displace the balls by pressing play button 20, pulling arm 18 or using some other device to displace or eject the balls 110 from the receptacles 108 in the matrix. The award display 118 and activations remaining display 120 operate as described above and are located on the display device 30.

Figure 3A:
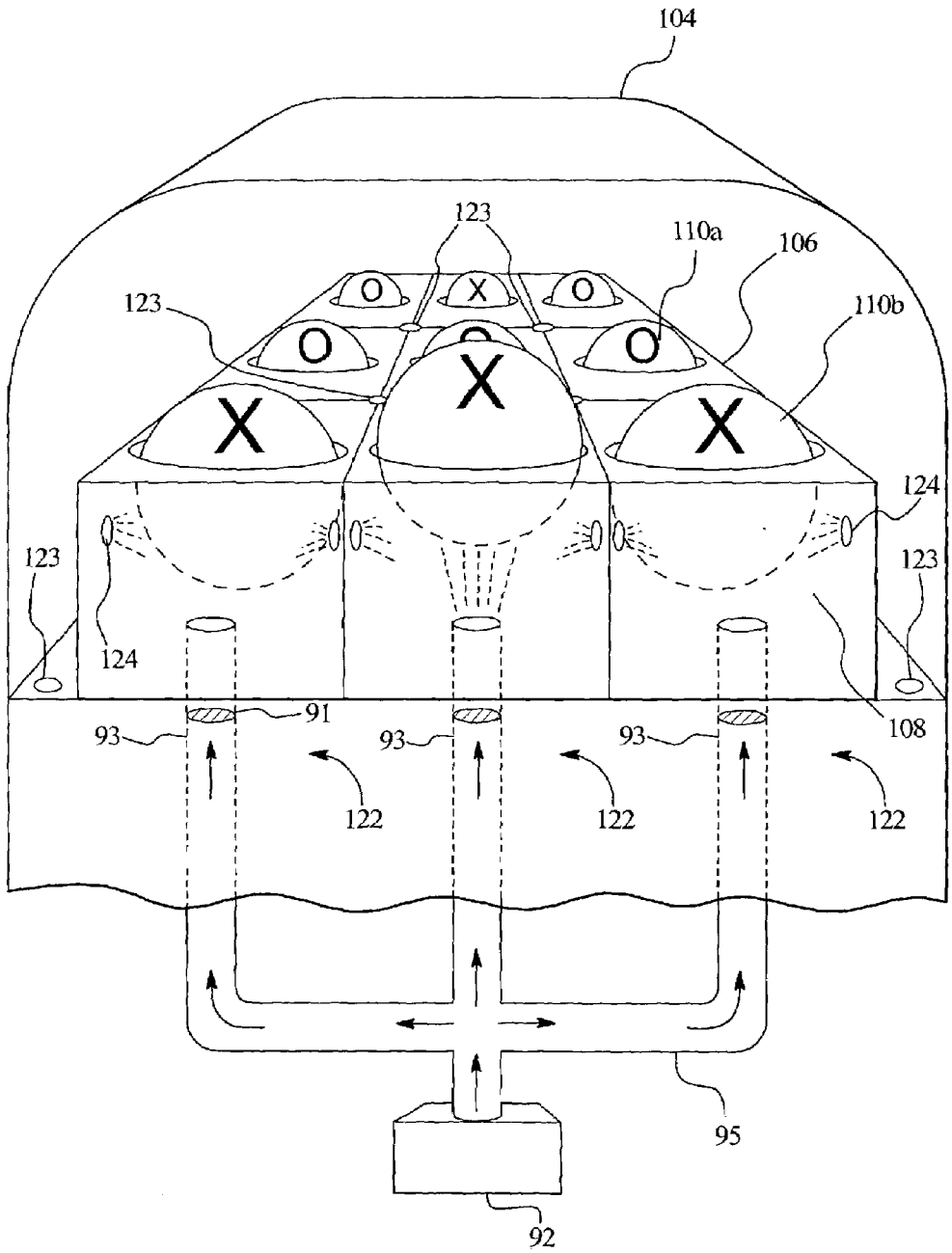
FIG. 3A is a fragmentary perspective view of one embodiment of the gaming device of the present invention where the receptacles of the matrix have air-type ejectors.

Referring now to FIG. 3A, an embodiment of one type of ejector is illustrated where an air-type ejector or air blower 122 is used to eject or displace the balls from the receptacles 108 in the matrix 106. In this illustration, the matrix 106 defines a three by three configuration of receptacles 108. In one embodiment, at least one sensor 124 is mounted or positioned along the contour of the receptacle as shown in FIG. 3A. In the illustrated embodiment, there are two sensors 124 per receptacle 108. However, it should be appreciated that any suitable number of sensors 124 may be used to sense or detect the members in the receptacles.

In one embodiment, the sensors are magnetic sensors that detect magnetic material placed inside the first and second balls. For example, the first balls include a magnetic material and the second balls do not include a magnetic material. In another embodiment, the sensors are weight sensors that detect the weight of each of the first and second members. In this embodiment, the sensors may be attached to the ejectors in a suitable manner so that the weight of the balls is resting on top of the sensors. In other embodiments, suitable optical sensors, material sensors, color sensors, code sensors, analog signal sensors, or digital signal sensors may be employed. It should be appreciated that any suitable type of sensor may be used in the present invention.

The sensors 124 communicate with processor 38 (see FIG. 2). Each sensor detects whether a particular ball is a first ball 110*a* or a second ball 110*b* engaged in each receptacle based on the characteristics associated with the balls. This information is communicated to the processor so that the processor can determine whether there is one or more winning combinations of first and/or second balls in the matrix. Similarly, the control sections 116 shown in FIGS. 1A and 1B are in communication with the processor so that the processor can activate the ejectors associated with the control sections selected by the player.

In one embodiment, each air blower 122 includes an air communication line 93 connected to an air generator 92 such as an air compressor or other suitable air generation device. The air generator 92 may either be in the gaming device 10 or at some remote location and connected to the gaming device with suitable tubing (as shown in FIG. 3A). In FIG. 3A, the air generator 92 generates air which is directed to a manifold 95. The manifold then directs the air to each air blower 122. The air communication lines 93 are flexible tubes that are made of a durable material such as rubber that can withstand suitable levels of air pressure. Valves 91 are used to control the air flow through the air communication lines 93. It should be appreciated that any suitable valve or regulator may be used to control the air flow. In this embodiment, the opening and closing of each valve 91 is electrically controlled by the processor 38. Once the valve 91 is open, the air supplied to the air communication lines moves past the valve and upward through the air communication lines 93 associated with the receptacles 108. The pressure or force of the air pushes against the bottom of a first or second ball, 110*a* or 110*b*, engaged in the receptacle and ejects or displaces the ball from the receptacle as illustrated in FIG. 3A.

Additionally, intermediate air blowers 123 are positioned and connected to locations in the matrix where a ball is likely to get stuck such as between the receptacles or along the edges in the matrix. Vents or slots connected to the air generator with suitable tubing (not shown) may be used at the edges of the matrix to move balls that are stuck at the edges towards open receptacles. The processor 38 then closes the valve 91 and stops the air flow through the air communication lines. Stopping the air flow through the air communication lines in the receptacles enables the balls to fall back to the matrix and re-engage the receptacles 108.

Figure 3B:
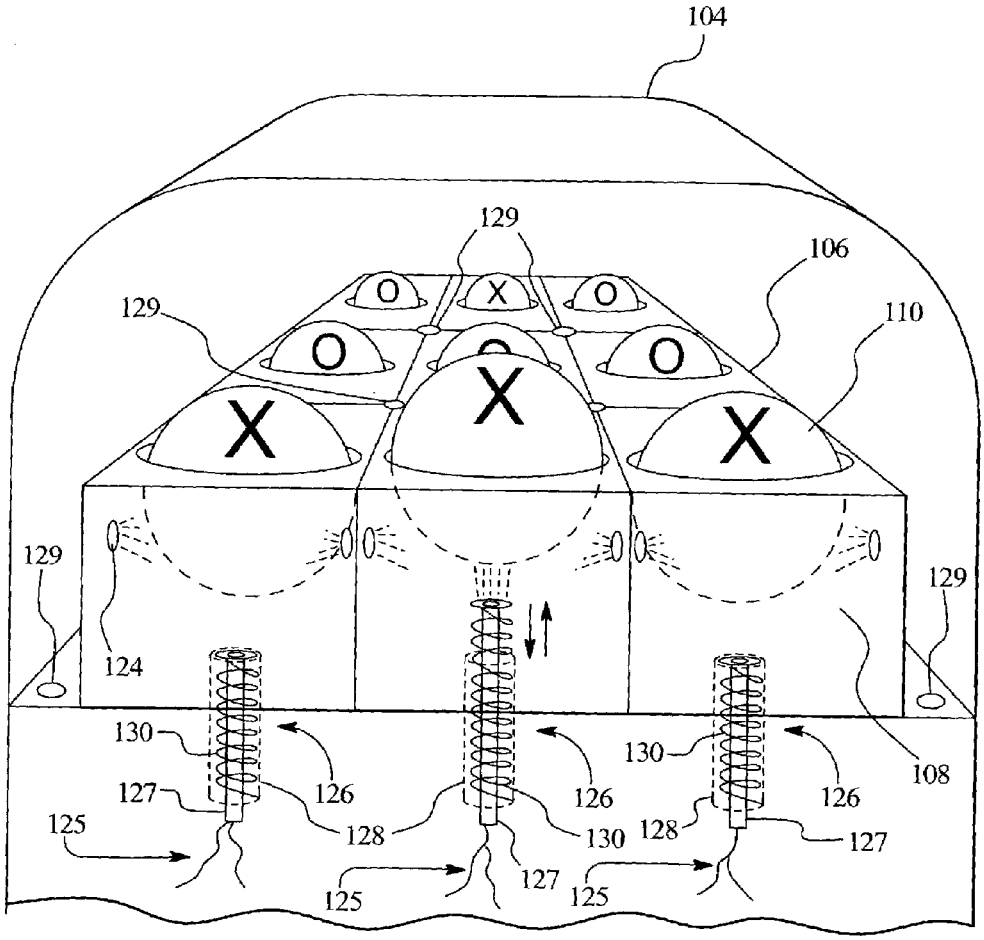
FIG. 3B is a fragmentary perspective view of another embodiment of the gaming device of the present invention where the receptacles of the matrix have mechanical ejectors.

Referring to FIG. 3B, another embodiment of the present invention is illustrated where a mechanical ejector 126, such as a spring-loaded piston or solenoid, is used to eject the first and second balls 110*a* and 110*b* from the receptacles 108. As described above, the sensors 124 detect the presence of a ball in a receptacle and the type of ball (whether it is a first ball or a second ball) in that receptacle based on differing magnetic forces, weights or other characteristics. This information is communicated by the sensors 124 to the processor 38. The player views the locations of the balls 110 in the matrix 106 and selects the controls sections associated with the positions of the first and second balls that the player wishes to eject from the matrix. When the player is finished selecting control sections, the processor communicates with the mechanical ejectors 126 via wires 125, or similar communication devices, to activate the ejectors and displace or eject the first and second balls associated with selected control sections.

The mechanical ejectors 126 include pistons 127, which are preferably surrounded by a housing 128. A compression spring 130 is coupled with each piston 127. The pistons 127 and compression springs 130 are compressed and held in place. Once a first or second ball is selected to be ejected from a receptacle 108, the compressed spring 130 is released and pushes against the piston 127. This spring action causes the piston 127 to move upwards and strike the bottom of a first or second ball (shown in phantom). The piston contacts or hits the ball with enough force to eject or displace the ball from its receptacle 108 and into the air within the housing 104 as illustrated in FIG. 3B. Although a spring-type piston is illustrated in FIG. 3B, it should be appreciated that other types of mechanical devices such as hydraulic pistons, vibration devices, solenoids or actuators may also be used to displace the first and second balls 110*a* and 110*b* from the receptacles 108 in the matrix. Furthermore, intermediate ejectors 129 are positioned and connected between the receptacles in the matrix and at the edges of the matrix to eject or move balls toward open receptacles. The intermediate ejectors 129 may be mechanical ejectors 126, air blowers 122 or any combination of suitable ejectors. In another embodiment, the matrix is molded so that the areas of the matrix between the receptacles and along the edges of the matrix are angled towards the receptacles. The angled areas of the matrix can be used in conjunction with the intermediate ejectors to move balls towards open receptacles.

Referring now to FIGS. 1A, 1B, 2 and 4A, a flow diagram of one embodiment of the game of the present invention is illustrated where the gaming device automatically ejects the first and second balls 110*a* and 110*b* from the receptacles 108 in the matrix 106 for a number of activations or ejections.

Figure 4A:
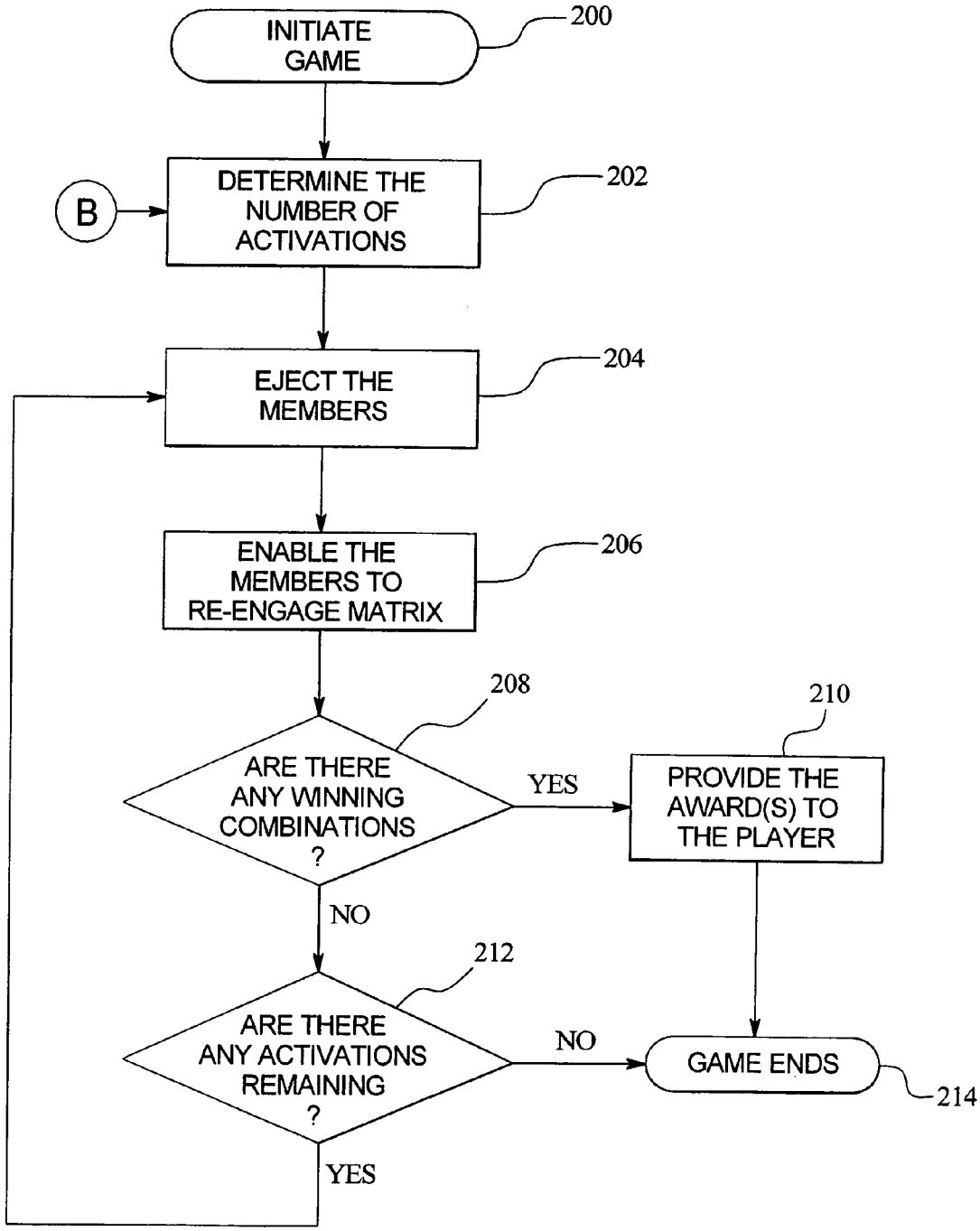
FIG. 4A is a flow diagram of the operation of one embodiment of the present invention where the gaming device automatically ejects all of the first and second members from the receptacles in the matrix for a number of activations or ejections.

Upon a triggering event in the primary game, the gaming device initiates the interactive matrix game in accordance with a gaming scheme and rules as indicated by block 200 in FIG. 4A. The object of the game of the present invention is for a player to obtain the highest possible award by achieving at least one winning combination of first and/or second balls 110*a* and 110*b* in the matrix 106. Initially, the first and second balls 110*a* and 110*b* are engaged in receptacles in a three-dimensional matrix within the housing 104. Each ball 110*a* and 110*b* is marked with a first symbol or a second symbol such as an "X" and an "O." The processor 38 in the gaming device determines a number of activations or ejections to provide to the player at the beginning of the game as indicated by block 202. As illustrated in FIG. 4D, the number of activations or ejections may be predetermined (203*a*), randomly determined by the processor (203*b*), based on the player's wager in the primary game (203*c*), or determined in a separate game (203*d*) or sub-game (203*e*).

The game begins by ejecting or displacing all of the first and second members such as first and second balls 110*a* and 110*b* from the receptacles in the matrix as indicated by block 204. The ejected first and second balls then re-engage the receptacles in the matrix. The first and second balls may either re-engage the same receptacle that the ejected ball was engaged in prior to being ejected, or re-engage a different receptacle in the matrix. The player reviews the positions or locations of the first and second balls 110*a* and 110*b* in the matrix to determine how the player should proceed in the game. The awards received by the player are based on predetermined arrangements or winning combinations of the first and second balls 110*a* and 110*b* within the matrix. An award is preferably provided to a player when the player obtains a winning combination. In one embodiment, the winning combinations include a horizontal, vertical and diagonal combination of first and/or second balls 110*a* and 110*b* in the receptacles in the matrix. Additionally, a first or second ball in each of the corner receptacles in the matrix is a winning combination. It should be appreciated that a game is not limited to the above winning combinations. Each game may include different winning combinations that provide one or more awards to a player. If more than one winning combination of first and/or second balls occurs in the matrix, the player may receive the highest award associated' with the winning combinations or the total award associated with all of the winning combinations. Thus, the players' goal is to obtain the winning combinations that provide the largest possible award to the player in the game.

Referring back to FIG. 4A, the processor 38 determines if there are any winning combinations of first and/or second balls 110*a* and 110*b* in the matrix as indicated by diamond 208. In one embodiment, any winning combinations and associated awards are displayed to the player. In another embodiment, only the awards associated with the winning combinations are displayed to the player. If the player only has one activation or ejection remaining in the game, then the game ends after the first activation or ejection. The player receives any awards associated with the winning combinations, if any, in the matrix. If there are no winning combinations in the matrix, the game ends and the player does not receive any awards in the game. In alternative embodiments, if a winning combination occurs and one or more activations or ejections are remaining, the gaming device can enable the player to accumulate multiple winning combinations and the awards associated with such multiple winning combinations, or could provide an offer and acceptance mode to the player. In the offer and acceptance mode, the player may have the option of keeping a winning combination and the associated award, and the option of risking that award for a potentially larger award based on a different winning combination. In such embodiment, the gaming device would include suitable offer acceptors and rejecters in communication with the processor for accepting or rejecting the offer associated with the winning combination.

Therefore, the processor determines if the player has any activations or ejections remaining in the game as indicated by diamond 212. If the player has one or more activations or ejections remaining in the game after the initial activation or ejection and there are no winning combinations, the gaming device ejects all of the first and second balls 110*a* and 110*b* from the receptacles in the matrix again as indicated by block 204. The processor 38 determines if there are any winning combinations in the matrix as described above. The first and second balls 110*a* and 110*b* continue to be ejected from the receptacles in the matrix until there are no activations or ejections remaining or until one or more winning combinations occur in the matrix. The player receives the total award associated with any winning combinations that occur in the matrix and the game ends as indicated by blocks 210 and 214, respectively.

Referring now to FIGS. 1A, 1B, 2 and 4B, the flow diagram illustrates another embodiment of the present invention where the gaming device enables a player to pick or select first and second balls 110*a* and 110*b* to eject from the receptacles in the matrix after each activation or ejection. In this embodiment and as described above, the game is initiated and the processor 38 determines a number of activations or ejections to provide to the player in the game as indicated by blocks 200 and 202, respectively. Initially, the gaming device ejects all of the first and second balls 110*a* and 110*b* from the matrix as indicated by block 204. The balls re-engage the receptacles in the matrix as indicated by block 206. The processor then determines if there are any winning combinations of first and/or second balls in the matrix as indicated by diamond 208. If there are one or more winning combinations of first and second balls 110*a* and 110*b* in the matrix, the gaming device provides at least one award to the player as indicated by 210, and the game ends as indicated by block 214.

If there are no winning combinations after the initial ejection of the balls, the processor determines if there are any activations or ejections remaining in the game as indicated by diamond 212. If there are no activations or ejections remaining in the game, the game ends and the player does not receive an award in the game. If there are activations or ejections remaining in the game, the gaming device enables the player to pick or select first and second balls to eject from the matrix as indicated by block 216. The player picks the first and second balls that the player wants to eject from the matrix by pressing or touching the control sections 116 (as shown in FIGS. 1A and 1B) associated with the receptacles that include the first and second balls. Thus, a player can attempt to obtain certain winning combinations of first and/or second balls in the matrix based on the positions of the balls in the matrix after each activation or ejection. Furthermore, the player has some control or choice on the types of winning combinations the player wants to obtain in the game, which provides additional excitement to the player. It should be appreciated that in this embodiment the plurality of members have at least two different symbols and that the members could have more than two different symbols.

In an alternative embodiment, the number of receptacles is greater than the number of members. In one such embodiment, the winning combination(s) are based on which receptacles receive the members. In such embodiment, the members may have no symbols or one or more symbols. In another such embodiment, the winning combination(s) are based on which receptacles receive which members with which symbols, wherein different members have different symbols.

In a further alternative embodiment, the gaming device includes less receptacles than members and the members have a plurality of different symbols. In one such embodiment, the winning combinations are based on which members are received in the available receptacles. For instance, one winning combination could occur if a designated receptacle receives a designated member.

After the player picks the first and second balls that the player wants to eject from the matrix, the gaming device ejects the selected balls from the matrix as indicated by block 218. In one embodiment, the processor prompts the player to press a button or other input to notify the processor when the player has finished selecting balls to eject from the matrix. In another embodiment, a time limit or time period is provided to the player to pick the first and second balls to eject from the matrix. Once the time period expires, the selected balls are ejected from the matrix. After the first and second balls are ejected from the matrix, the balls re-engage the receptacles in the matrix as indicated by block 206. The process continues as described above until the player obtains one or more winning combinations or until there are no activations or ejections remaining in the game. If the player obtains one or more winning combinations in the game, the gaming device provides the award or awards associated with the winning combinations as indicated by block 210 and the game ends as indicated by block 214.

Figure 4B:
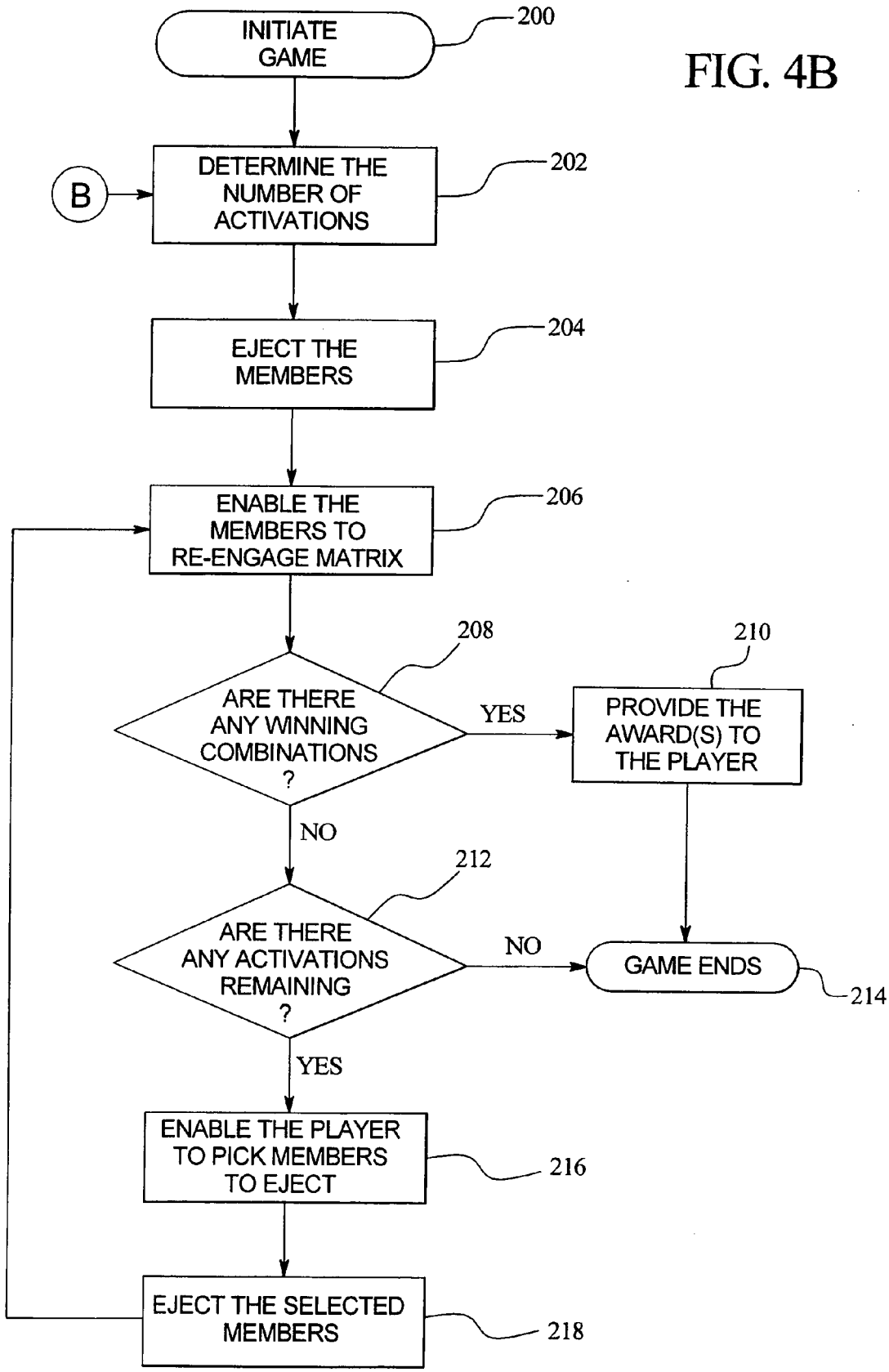
FIG. 4B is a flow diagram of the operation of another embodiment of the present invention where the gaming device enables a player to independently select first and second members to eject from the receptacles in the matrix for a number of activations or ejections or until the player obtains a winning combination of first and/or second members.

Referring now to FIGS. 1A, 1B, 2 and 4C, a flow diagram of the embodiment of FIG. 4B is illustrated where the gaming device enables a player to keep or reject winning combinations in the game. In this embodiment, the game proceeds as described above for FIG. 4B. However, when one or more winning combinations of first and/or second balls 110*a* and 110*b* occur in the matrix 106, the gaming device enables the player to decide whether the player wants to keep the winning combinations as indicated by diamond 220. In this manner, the player can risk losing an award associated with one winning combination to attempt to obtain another award, and possibly a larger award, associated with another winning combination. Therefore, the player can attempt to obtain the largest possible award in the game in each activation or ejection. This process increases a player's excitement and enjoyment of the game because the player always has an opportunity to obtain the largest award in the game.

Figure 4C:
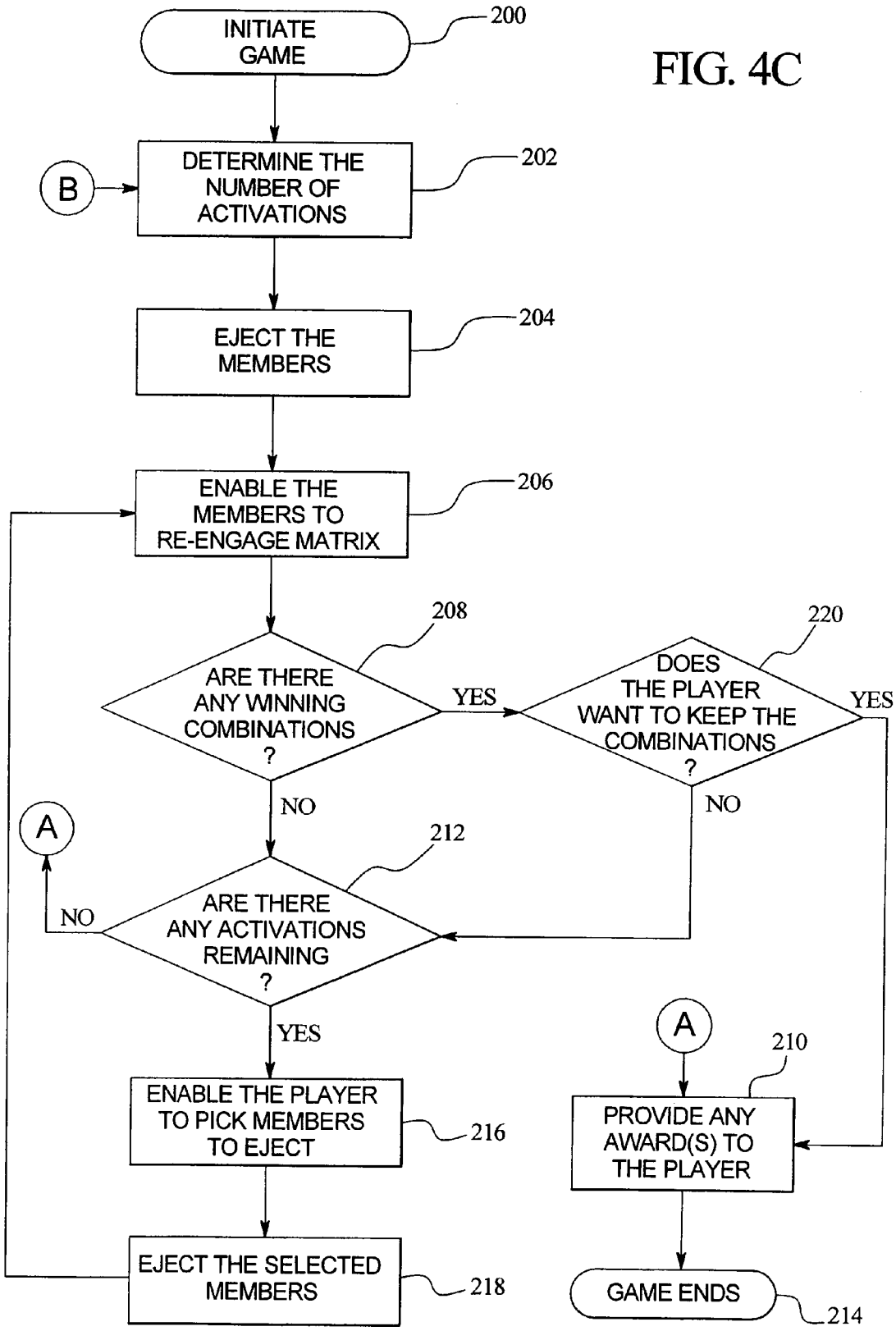
FIG. 4C is a flow diagram of the operation of the embodiment in FIG. 3B where the gaming device enables the player to choose whether the player wants to keep a particular winning combination of first and/or second members.
Figure 4D:
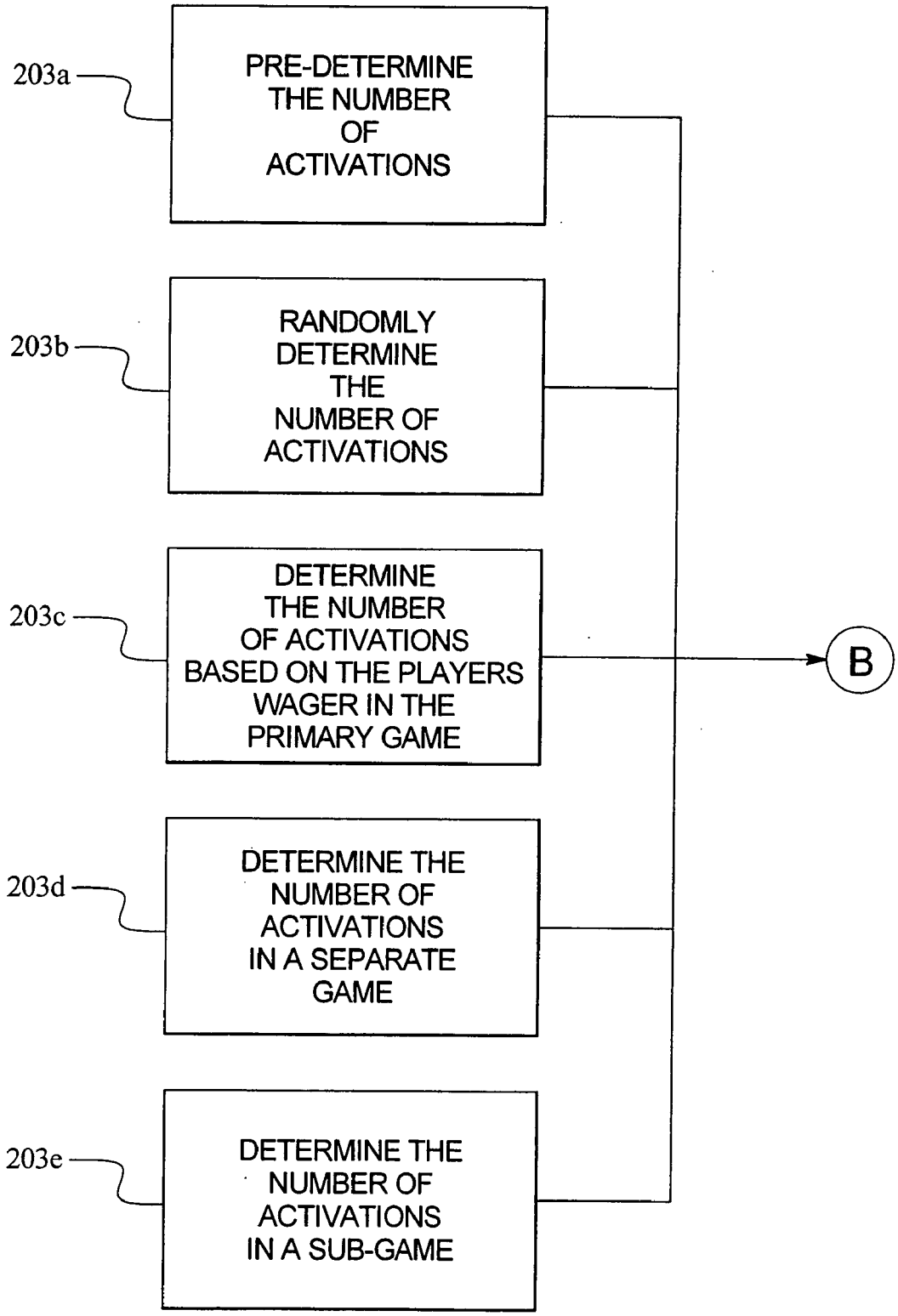
FIG. 4D is a flow diagram associated with the embodiments in FIGS. 4A, 4B and 4C illustrating different methods of determining the number of activations in a game.

In FIG. 4C, if the player decides to keep the winning combination or combinations that the player obtained in an activation or ejection, the player presses a button (not shown) or similar input device to notify the processor of their decision. The processor (i.e., gaming device) provides the award or awards associated with the winning combinations obtained by the player as indicated by block 210 and the game ends as indicated by block 214. If the player decides not to keep the winning combination or combinations, the player presses a different button (not shown) or input device to notify the processor of this decision. The processor then determines if the player has any activations or ejections remaining in the game as indicated by diamond 212. If there are activations or ejections remaining in the game, the processor enables the player to pick first and/or second balls to eject from the matrix as indicated by block 216 and as described above. The player continues to pick first and second balls to eject from the matrix and decide whether to keep any winning combinations obtained in the activations or ejections until there are no activations or ejections remaining in the game. The player receives the total accumulated award obtained in the game as indicated by block 210 and the game ends as indicated by block 214.

Figure 5A:
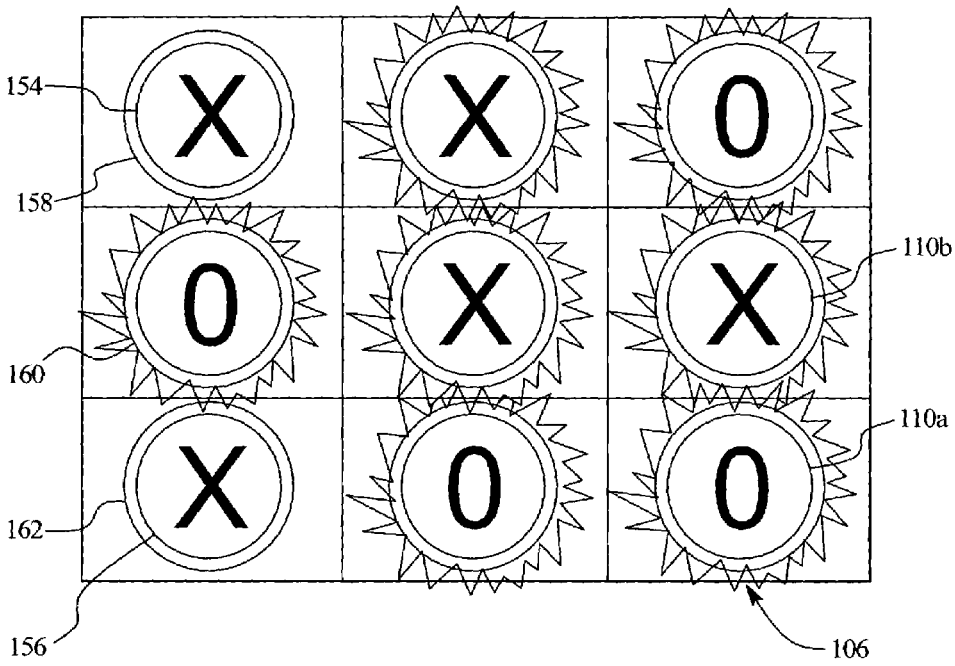
FIGS. 5A and 5B are enlarged top plan views of the matrix and members of the present invention removed from the housing illustrating two activations or ejections in a bonus game where a player obtains winning combinations of members in the matrix.
Figure 5B:
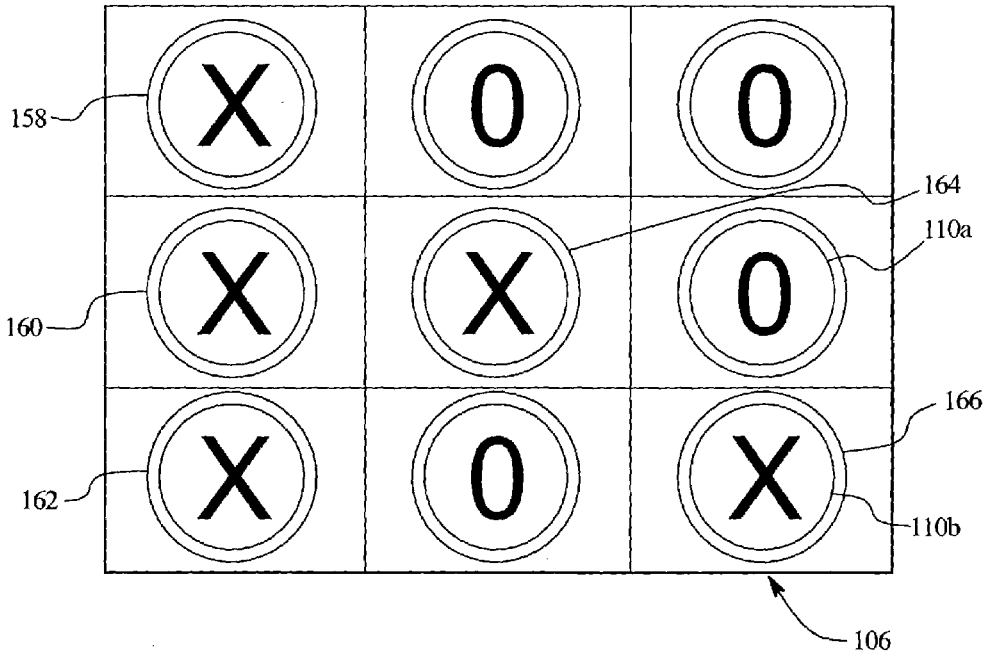

Referring to FIGS. 5A and 5B, an example of the embodiment of FIG. 4B is illustrated where a player has one activation or ejection in a game. After the initial activation or ejection, the player did not obtain any winning combinations of first or second balls in the matrix. Thus, the processor enables the player to pick one or more balls 110*a* and 110*b* to eject from the matrix 106. In FIG. 5A, the player chooses to eject all of the balls from the matrix except for balls 154 and 156 by pressing or touching the control sections 116 that correspond to the receptacles 158 and 162 that the balls are engaged in the matrix. The player attempts to obtain a vertical winning combination of balls in receptacles 158, 160 and 162. The processor communicates with the ejectors connected to the receptacles corresponding to the selected balls, to eject those balls from the matrix. All of the selected balls are ejected from the matrix.

Referring to FIG. 5B, the location of the first and second balls 110*a* and 110*b* is illustrated where the balls re-engaged the matrix. The player obtained the vertical combination of second balls in receptacles 158, 160 and 162, which is a winning combination in the game. The player also obtained another winning combination of second balls in receptacles 158, 164 and 166 arranged along the diagonal in receptacles. In this embodiment, the player receives the total award associated with the sum of the awards for both winning combinations. In another embodiment, the gaming device provides the player with the largest award associated with the winning combinations. Since the player does not have any activations or ejections remaining in the game, the game ends and the player obtains the total award associated with both indicated winning combinations.

Figure 6:
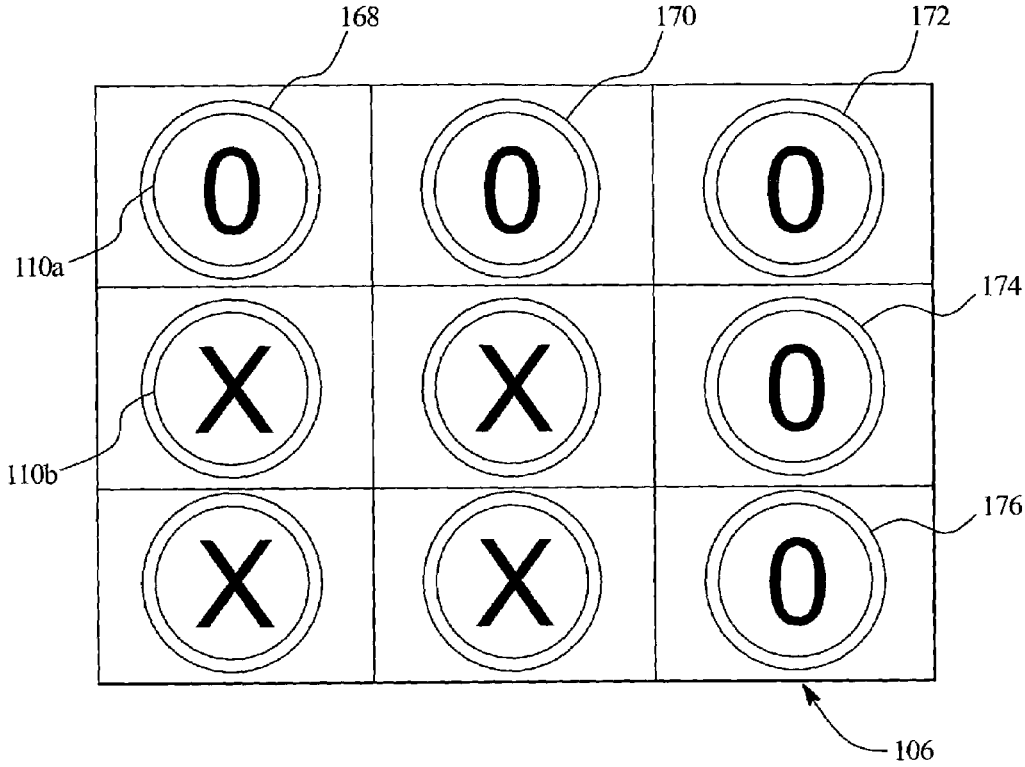
FIG. 6 is an enlarged top plan view of the matrix of the present invention illustrating an embodiment of the present invention where the first members are arranged horizontally and vertically in the matrix.
Figure 7:
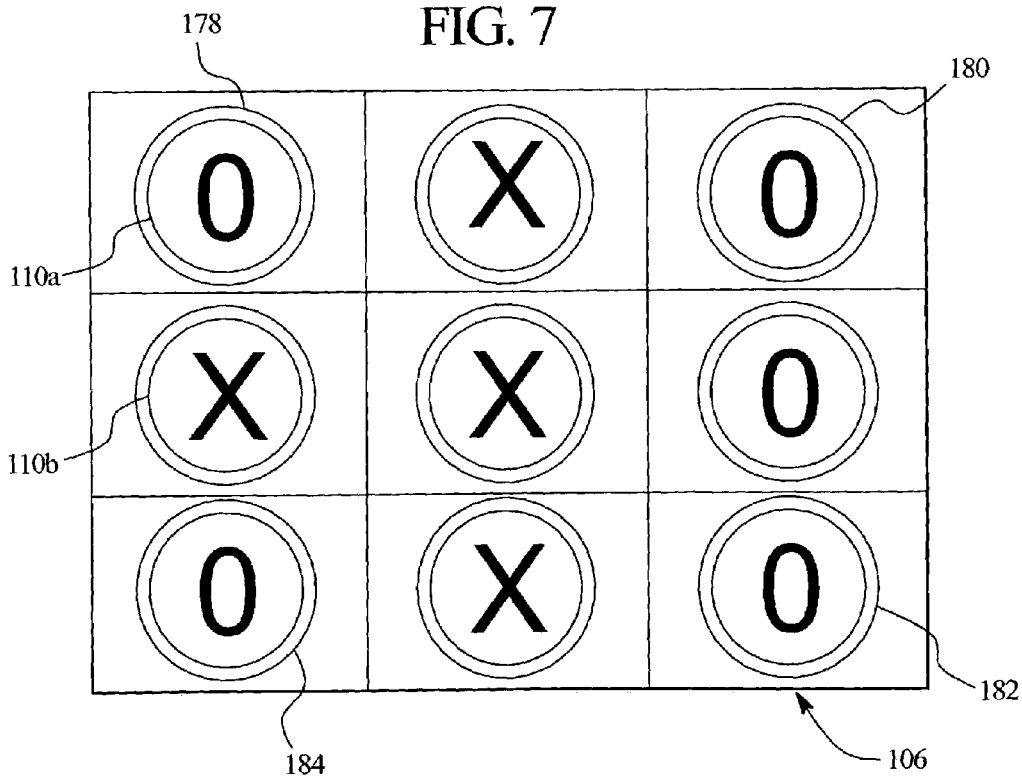
FIG. 7 is an enlarged top plan view of the matrix of the present invention illustrating another embodiment where the first members are located in each corner receptacle in the matrix.

Referring now to FIGS. 6 and 7, other winning combinations are illustrated where a player may receive one or more awards associated with the winning combinations. In FIG. 6, the player may receive an award for the horizontal row of first balls, designated with an "O," in receptacles 168, 170 and 172, or for the vertical column of first balls in receptacles 172, 174 and 176. Preferably, a player only receives one award in a game, however, it is contemplated that a player may receive multiple awards as desired by the game implementor.

Referring to FIG. 7, another embodiment of the present invention is illustrated where a player receives an award for obtaining a first ball designated with the symbol "O," in each of the four corners of the matrix 106. For example, the player obtained a first ball in receptacles 178, 180, 182 and 184 located in each of the four corners of the matrix 106. Therefore, the player receives an award for obtaining this combination of balls in the matrix. Although, certain combinations will generate an award to a player as shown, any combination or series of first and/or second balls may generate an award as desired by the game implementor.

Figure 8:
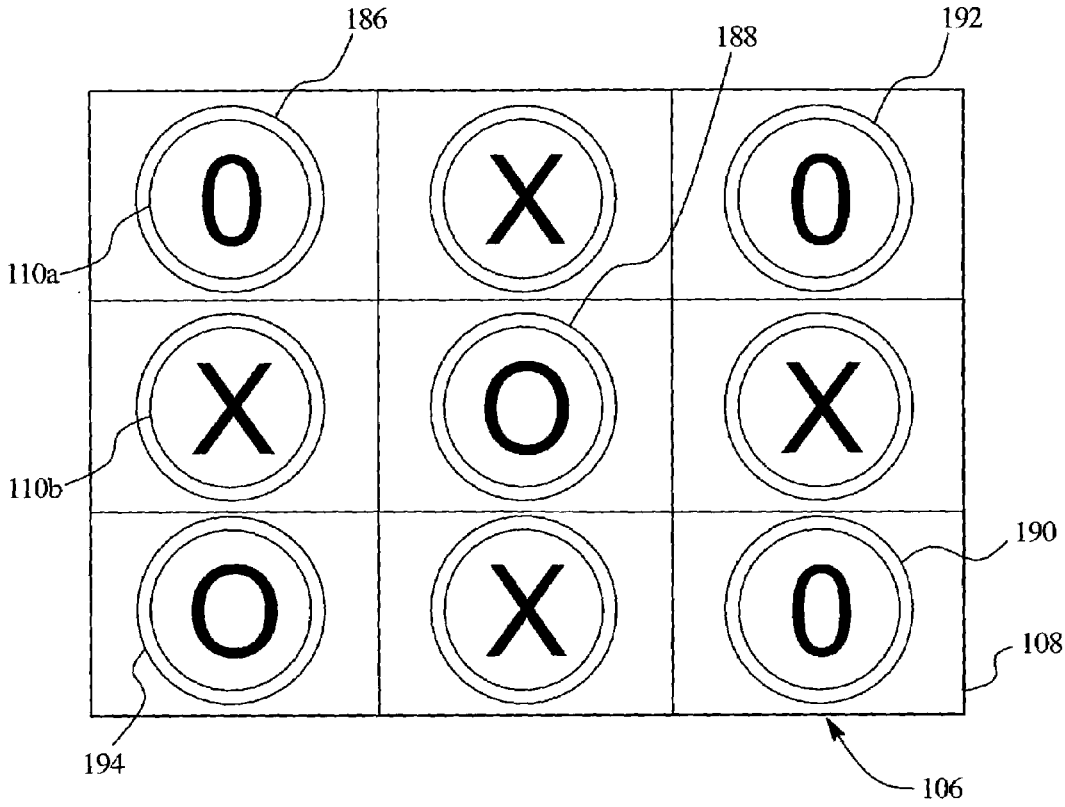
FIG. 8 is an enlarged top plan view of the matrix of the present invention illustrating another embodiment where the first members are arranged along both diagonals in the matrix.

Referring to FIG. 8, one embodiment of the present invention is illustrated where multiple winning combinations of balls occurs in the matrix. One winning combination is represented by the first balls designated with an "O" symbol in receptacles 186, 188 and 190, which are arranged along one diagonal in the matrix. A second winning combination of first balls in receptacles 192, 188 and 194 are arranged along the other diagonal in the matrix. A third winning combination of first balls in receptacles 186, 192, 190 and 194 are arranged in each of the corners of the matrix. Therefore, in one embodiment, the player receives the largest award associated with only one of the three winning combinations. In another embodiment, the player receives the total award for all three winning combinations in the matrix.

Figure 9:
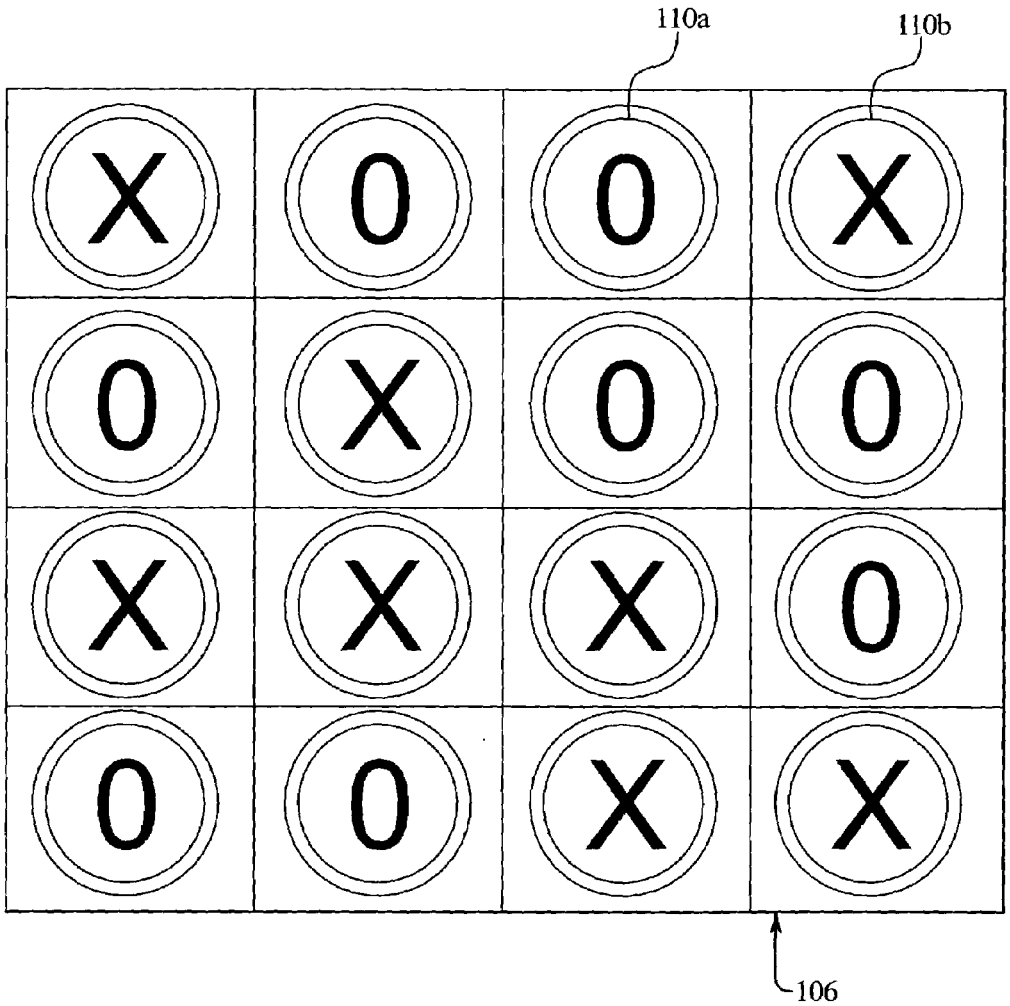
FIG. 9 is an enlarged top plan view of a further embodiment of the present invention illustrating a matrix including a four by four receptacle configuration.

Referring now to FIG. 9, an alternative embodiment of the present invention is illustrated where the matrix defines several receptacles arranged in a four by four configuration. It should be appreciated that a matrix may define any number of receptacles and that the receptacles may be in any configuration or shape as desired by the game implementor. In this embodiment, the player may receive awards for aligning four first and/or second balls 110*a* and 110*b* in a row, column or along the diagonal of the matrix 106 or in any other winning combination desired by the game implementor.

Figure 10:
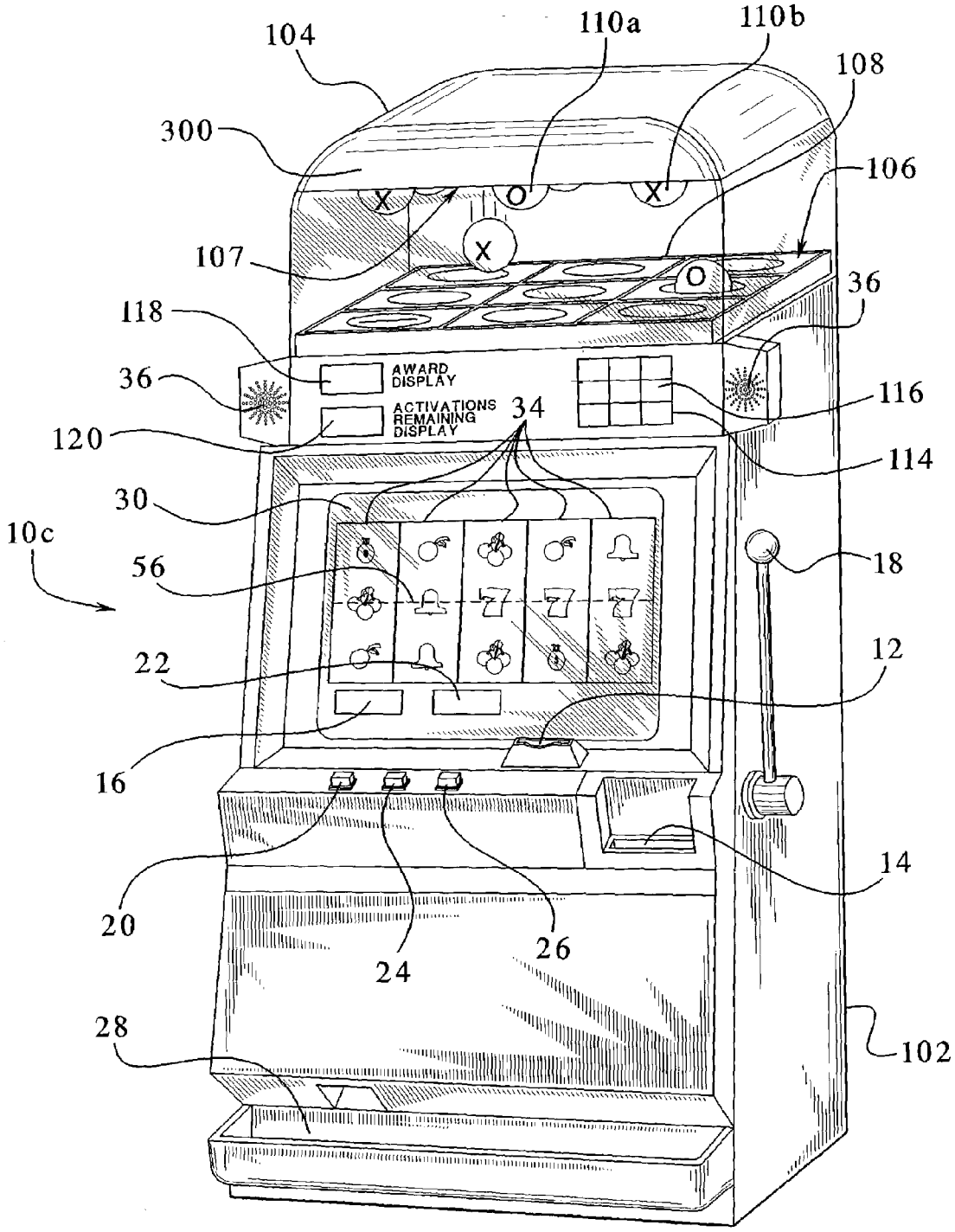
FIG. 10 is a front perspective view of an alternative embodiment of the present invention.

Referring to FIG. 10, an alternative embodiment of the present invention is illustrated where a holding device 300 is connected inside the top of the housing 104. The holding device 300 is adapted to hold one or more of the first and second balls 110*a* and 110*b* in first receptacles 107. At the beginning of the game, all of the first and second balls are held by the holding device. The balls are then released and allowed to drop into the receptacles 108 in the matrix 106. The first and second balls may be released and dropped independently or all at once. If the balls are released independently, the player may choose which first and second balls are released from the holding device using control sections 116 as described above. In one embodiment, the player attempts to obtain a winning combination of first and/or second balls as described above. In another embodiment, the player attempts to place a particular first or second ball in one or more of the receptacles 108 (i.e., target receptacles) in the matrix. Once all of the first and second balls are released from the holding device, the game ends and the player obtains the award or awards associated with the winning combinations or one or more winning receptacles in the matrix as indicated by award display 118.

In another embodiment, if the player did not obtain at least one winning combination in the second receptacles 108 after releasing all of the first and second balls from the first receptacles 107 in the holding device 300, the gaming device enables the player to independently select and displace the first and second members from the second receptacles in the matrix as described above. The player continues to select and displace first and second balls from the second receptacles in the matrix until the player obtains one or more winning combinations of first and/or second balls or until there are no activations or ejections remaining in the game. The player receives an award or awards based on the winning combinations that occur in the second receptacles in the matrix.

As indicated above, it should be appreciated that the members could be of any suitable alternative forms such as spheres, balls, and multi-sided objects such as dice. As also indicated above, it should be appreciated that the matrix can be of different forms or of different patterns. Additionally, the receptacles could be on different levels or tiers or multiple levels or tiers. In such embodiments, the winning combinations and awards could be related to the different levels or tiers.

It should also be appreciated that the matrix and the members could in an alternative embodiment be represented by video or audio-video representations. In one embodiment, the representations are made by three dimensional video representations which provide the movement of the members in accordance with physical properties.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A gaming device comprising:

a primary game operable upon a wager made by a player;

a secondary game initiated upon the occurrence of a triggering event in the primary game;

a housing;

a matrix connected to the housing, said matrix defining a plurality of receptacles;

a plurality of members adapted to engage the receptacles;

a plurality of ejectors associated with the receptacles for displacing the members from the receptacles;

a designated number of ejections of the ejectors, wherein the designated number of ejections is randomly determined; and a processor in communication with the ejectors, wherein upon the initiation of the secondary game, the processor is operable to cause the ejectors to displace at least one of the members from the receptacles for each ejection up to the designated number of ejections, determine if any winning combination of members occur in the receptacles after the members re-engage the receptacles after each ejection and provide an award to a player if at least one winning combination of members engages the receptacles after at least one of the ejections.

2. The gaming device of claim 1, wherein the matrix includes M number of rows and N number of columns.

3. The gaming device of claim 2, wherein M equals N.

4. The gaming device of claim 1, wherein the number of members is less than or equal to the number of receptacles.

5. The gaming device of claim 1, wherein the winning combination includes at least two designated members engaging adjacent receptacles.

6. The gaming device of claim 5, wherein the winning combination of members is at least one of the combinations selected from the group consisting of: at least two designated members in a row of receptacles, at least two designated members in a column of receptacles, at least two designated members in a diagonal of receptacles and at least two designated members in at least two corner receptacles.

7. The gaming device of claim 1, wherein the winning combination is based on at least one designated receptacle in the matrix and the processor is operable to provide an award to the player when one of the members engages said receptacle.

8. The gaming device of claim 1, wherein the members include a plurality of first members and a plurality of second members.

9. The gaming device of claim 8, wherein the first members include a first characteristic and the second members include a second different characteristic.

10. The gaming device of claim 9, wherein the first characteristic is an "X" and the second characteristic is an "O."

11. The gaming device of claim 1, which includes at least one sensor associated with each receptacle in the matrix, wherein each sensor detects whether one of members is engaged in said receptacle.

12. The gaming device of claim 11, wherein the sensors are selected from the group consisting of magnetic sensors, weight sensors, material sensors, optical sensors, color sensors, code sensors, analog signal sensors, and digital signal sensors.

13. The gaming device of claim 1, wherein the ejectors include solenoids.

14. The gaming device of claim 1, wherein the ejectors include air blowers.

15. The gaming device of claim 14, wherein the air blowers include valves.

16. The gaming device of claim 1, which includes an additional award provided to the player when two or more winning combinations of members engaging the receptacles in the matrix.

17. The gaming device of claim 1, which includes at least one additional ejection of at least one member associated with at least one of the receptacles in the matrix.

18. The gaming device of claim 1, which includes at least one selector for enabling a player to independently accept or reject a winning combination of members in the matrix.

19. The gaming device of claim 1, which includes at least one selector for enabling a player to pick and cause the ejector to eject one or more of the members from the receptacles in the matrix.

20. The gaming device of claim 1, which includes at least one selector for enabling a player to pick and maintain one or more of the members in the receptacles in the matrix.

21. The gaming device of claim 1, wherein the members are spherical.

22. The gaming device of claim 1, wherein the matrix has at least one level.

23. The gaming device of claim 1, wherein the number of members is greater than the number of receptacles.

24. A gaming device comprising:

a primary game operable upon a wager made by a player;

a secondary game initiated upon the occurrence of a triggering event in the primary game;

a housing;

a matrix connected to the housing, said matrix defining a plurality of receptacles;

a plurality of members adapted to engage the receptacles;

a plurality of member ejectors associated with the receptacles;

a selector for accepting or rejecting at least one combination of members engaged in the receptacles;

a designated number of ejections of the ejectors, wherein the designated number of ejections is randomly determined; and a processor in communication with the member ejectors and selector, wherein upon the initiation of the secondary game, said processor is operable to cause the ejectors to displace at least one of the members from the receptacles for each ejection up to the designated number of ejections, determine if the combinations of members occurring in the receptacles include any winning combinations after the members re-engage the receptacles after each ejection, cause the selector to enable a player to accept or reject one or more of the combination of members in the receptacles after each ejection, cause the ejectors to displace at least one of the members if the player rejects said combination of the members and provide an award to the player if the player accepts the combination of members in the receptacles and the combination of members includes a winning combination.

25. The gaming device of claim 24, wherein the designated number of ejections is randomly determined and based on the player's wager in the primary game.

26. The gaming device of claim 24, wherein all of the combinations of the members engaged in the receptacles include winning combinations of the members.

27. The gaming device of claim 24, wherein the designated number of ejections is determined in a separate game or in a sub-game.

28. A gaming device comprising:

a primary game operable upon a wager made by a player;

a secondary game initiated upon the occurrence of a triggering event in the primary game;

a housing;

a matrix connected to the housing, said matrix defining a plurality of receptacles;

a plurality of members adapted to engage the receptacles;

a plurality of member ejectors associated with the receptacles;

a selector associated with each receptacle for independently selecting members to displace from each said receptacle;

a designated number of ejections of the ejectors, wherein the designated number of ejections is randomly determined; and a processor in communication with the ejectors and selectors, wherein upon the initiation of the secondary game, said processor is operable to cause the ejectors to displace at least one of the members from the receptacles for each ejection up to the designated number of ejections, determine if any winning combinations of members occur in the receptacles after the members re-engage the receptacles after each ejection, cause the selector to enable a player to independently select members to eject from the receptacles after each ejection, cause the ejectors to displace the selected members from the receptacles and provide an award to the player for any winning combinations of members that occur in the receptacles.

29. The gaming device of claim 28, wherein the plurality of selectors are provided by a touch screen.

30. The gaming device of claim 28, wherein the designated number of ejections is randomly determined and based on the player's wager in the primary game.

31. The gaming device of claim 28, wherein the designated number of ejections is determined in a separate game or in a sub-game.

32. A gaming device comprising:

a primary game operable upon a wager made by a player;

a secondary game initiated upon the occurrence of a triggering event in the primary game;

a housing;

a matrix connected to the housing, said matrix defining a plurality of receptacles;

a plurality of first and second members adapted to engage the receptacles;

a plurality of member ejectors associated with the receptacles;

a selector associated with each receptacle for independently selecting first and second members to eject from said receptacles;

a designated number of ejections of the ejectors, wherein the designated number of ejections is randomly determined; and a processor in communication with the ejectors and selectors, wherein upon the initiation of the secondary game, said processor is operable to cause the ejectors to displace at least one of the first and second members from the receptacles for each ejection up to the designated number of ejections, determine if any winning combinations of first or second members occur in the receptacles after the first and second members re-engage the receptacles after each ejection, cause the selector to enable the player to independently select first and second members to eject from the receptacles after each ejection, cause the ejectors to displace the selected first and second members from the receptacles and provide an award to the player for any winning combinations of first or second members that occur in the receptacles.

33. The gaming device of claim 32, wherein the first members include a first characteristic and the second members include a second different characteristic.

34. The gaming device of claim 32, which includes means for enabling the player to select whether the first or second members are included in the winning combinations.

35. The gaming device of claim 32, wherein the designated number of ejections is randomly determined and based on the player's wager in the primary game.

36. The gaming device of claim 32, wherein the designated number of ejections is determined in a separate game or in a sub-game.

37. A gaming device comprising:

a primary game operable upon a wager made by a player;

a secondary game initiated upon the occurrence of a triggering event in the primary game;

a housing;

a M×N matrix connected to the housing which defines a plurality of receptacles, wherein M represents the number of rows and N represents the number of columns of the receptacles in said matrix;

a plurality of first and second members adapted to engage the receptacles;

a plurality of member ejectors associated with the receptacles;

a number of activations of the ejectors, said number of activations randomly determined;

a selector associated with each receptacle for selecting first and second members to displace from the receptacles; and a processor in communication with the ejectors and selectors, wherein upon the initiation of the secondary game, said processor is operable to cause the ejectors to displace the first and second members from the receptacles until at least one winning combination occurs in the receptacles or until there are no activations remaining, determine if any winning combinations of first or second members occur in the receptacles after each time the first and second members re-engage the receptacles, cause the selectors to enable the player to independently select first and second members to displace from the receptacles, cause the ejectors to displace the selected first and second members from the receptacles, and provide an award to the player for any winning combinations of first or second members that occur in the receptacles.

38. The gaming device of claim 37, wherein M and N are each at least two.

39. The gaming device of claim 37, wherein the winning combination of first and second members is M first or second members aligned in horizontally arranged receptacles in the matrix.

40. The gaming device of claim 37, wherein the winning combination of first and second members is N first or second members aligned in vertically arranged receptacles in the matrix.

41. The gaming device of claim 37, wherein the winning combination of first and second members includes a diagonal arrangement of first or second members in the receptacles in the matrix.

42. The gaming device of claim 37, wherein the winning combination includes at least one first or second member in a plurality of corner receptacles in the matrix.

43. The gaming device of claim 37, which includes an additional award provided to a player for obtaining multiple winning combinations of first and second members in the receptacles in the matrix.

44. The gaming device of claim 37, wherein the number of activations is randomly determined and based on the player's wager in the primary game.

45. The gaming device of claim 37, wherein the designated number of ejections is determined in a separate game or in a sub-game.

46. A gaming device comprising:

a primary game operable upon a wager made by a player; a secondary game initiated upon the occurrence of a triggering event in the primary game;

a housing;

a holding device connected to the housing, said holding device defining a plurality of first receptacles;

a matrix connected to the housing, said matrix defining a plurality of second receptacles;

a plurality of members adapted to engage the first and second receptacles, wherein the members are initially held by the first receptacles of the holding device;

at least one selector associated with the first receptacles; and a processor in communication with the selector, said processor operable to enable the player to independently select members to release from the first receptacles, cause the first receptacles in the holding device to release the selected members to engage the second receptacles, and provide an award to the player for one or more winning combinations of members that occur in the second receptacles.

47. The gaming device of claim 46, wherein the members include a plurality of first members and a plurality second members.

48. The gaming device of claim 47, wherein the first members include a first characteristic and the second members include a second different characteristic.

49. The gaming device of claim 48, wherein the first characteristic is an "X" and the second characteristic is an "O."

50. The gaming device of claim 46, which includes at least one second selector associated with the second receptacles, wherein said second selector enables a player to independently select and displace members from the second receptacles in the matrix.

51. The gaming device of claim 50, wherein the designated number of displacements may be used in the primary game and the secondary game.

52. The gaming device of claim 50, wherein the designated number of displacements may be used in the primary game and which includes a randomly determined number of secondary game displacements that may be used in the secondary game.

53. The gaming device of claim 46, wherein the winning combination of members is at least one of the combinations selected from the group consisting of: at least two members in a row of receptacles, at least two members in a column of receptacles, at least two members in a diagonal of receptacles and at least two members in at least two corner receptacles.

54. The gaming device of claim 46, wherein the winning combination is based on at least one receptacle in the matrix and wherein the gaming device provides any award to the player when one of the members engages said receptacle.

55. A wagering gaming device comprising:

a primary game operable upon a wager made by a player;

a secondary game initiated upon the occurrence of a triggering event in the primary game;

a plurality of members;

a cabinet;

at least one receptacle connected to the cabinet, said receptacle adapted to receive each said member, one at a time;

a member ejector associated with each receptacle;

a number of ejections of the ejector, said number of ejections being randomly determined;

an award provided to a player based on which member is received in the receptacle; and a processor in communication with the receptacle, wherein upon the initiation of the secondary game, the processor is operable to cause each of the members to be received by the receptacle one at a time for the number of ejections and provide any awards to the player based on the members received by the receptacle.

56. The wagering gaming device of claim 55, which includes a plurality of receptacles, wherein the award provided to the player is based on which members are received in the receptacles.

57. A wagering gaming device comprising:

a primary game operable upon a wager made by a player;

a secondary game initiated upon the occurrence of a triggering event in the primary game;

a cabinet;

a member;

a plurality of receptacles connected to the cabinet, said receptacles each adapted to receive said member;

a member ejector associated with each receptacle;

a number of ejections of the ejectors, said number of ejections randomly determined;

an award provided to a player based on which receptacle receives the member; and a processor in communication with the receptacle, wherein upon the initiation of the secondary game, the processor is operable to cause the member to be received by one of the receptacles prior to each ejection and provide any awards to the player based on which receptacle received the member until there are no ejections remaining.

58. A method of operating a wagering gaming device, the method comprising the steps of:

(a) displaying a primary game to a player, wherein the primary game is operable upon a wager made by the player;

(b) initiating a secondary game upon an occurrence of a triggering event in the primary game;

(c) displaying a plurality of receptacles to a player, wherein a plurality of members are engaged in said receptacles;

(d) ejecting at least one of the members from the receptacles for a designated number of ejections, wherein the designated number of ejections is randomly determined;

(e) determining if any winning combinations of members occur in the receptacles after the members re-engage the receptacles for each of the ejections; and (f) providing an award to the player if at least one winning combination of members occurs in the receptacles for each of the ejections.

59. The method of claim 58, which includes the step of detecting whether a particular member is engaged in one of the receptacles using at least one sensor.

60. The method of claim 58, wherein the winning combination of members is at least one of the combinations selected from the group consisting of: at least two members in a row of receptacles, at least two members in a column of receptacles, at least two members in a diagonal of receptacles and at least two members in at least two corner receptacles.

61. The method of claim 58, which includes the step of enabling the player to independently select and displace members from the receptacles.

62. The method of claim 58, which includes the step of enabling the player to select and reject one or more combinations occurring in the receptacles.

63. The method of claim 58, wherein the gaming device is operated through a data network.

64. The method of claim 63, wherein the data network is an internet.

65. The method of claim 58, wherein determining the designated number of ejections includes randomly determining the number of ejections and modifying the randomly determined number of ejections based on the player's wager in the primary game.

66. The method of claim 58, wherein determining the designated number of ejections includes randomly determining the number of ejections in a separate game or in a sub-game.

67. A method of operating a wagering gaming device, the method comprising the steps of:

(a) displaying a primary game to a player, wherein the primary game is operable upon a wager made by the player;

(b) initiating a secondary game upon an occurrence of a triggering event in the primary game;

(c) randomly determining a number of ejections of a plurality of first and second members and modifying said number of ejections based on the wager made by the player in the primary game;

(d) displaying a plurality of receptacles to a player in the secondary game, wherein the plurality of first and second members are engaged in said receptacles and wherein the first and second members are different;

(e) ejecting at least one of the first and second members from the receptacles;

(f) determining if any winning combinations of first or second members occur in the receptacles after the first and second members re-engage the receptacles;

(g) enabling the player to accept or reject the winning combinations of first and second members that occur in the receptacles;

(h) ejecting at least one of the first and second members from the receptacles in the matrix if the player rejects the winning combinations of first or second members that occur in the receptacles;

(i) providing an award to the player if the player accepts any winning combinations of first or second members that occur in the receptacles; and (j) repeating steps (e) to (i) until the player accepts any winning combinations or until there are no ejections remaining.

68. The method of claim 67, wherein the gaming device is operated through a data network.

69. The method of claim 68, wherein the data network is an internet.

70. A method of operating a wagering gaming device, the method comprising the steps of:

(a) displaying a primary game to a player, wherein the primary game is operable upon a wager made by the player;

(b) initiating a secondary game upon an occurrence of a triggering event in the primary game;

(c) displaying a plurality of receptacles to a player wherein a plurality of first and second members are engaged in said receptacles upon the initiation of the secondary game;

(d) randomly determining a number of ejections of the members and modifying said number of ejections based on the wager made by the player in the primary game;

(e) ejecting at least one of the first and second members from the receptacles in the matrix;

(e) enabling the player to independently select first and second members to eject from the receptacles after the first and second members re-engage the receptacles;

(f) ejecting the selected first and second members from the receptacles in the matrix;

(g) providing an award to the player if any winning combinations of first and/or second members occur in the receptacles in the matrix after the first and second members re-engage the receptacles; and (h) repeating steps (e) to (g) until at least one winning combination of first or second members occurs in the receptacles or until there are no ejections remaining.

71. The method of claim 70, which includes the step of providing an additional award to the player when at least two winning combinations of first or second members occur in the receptacles.

72. The method of claim 70, wherein the gaming device is operated through a data network.

73. The method of claim 72, wherein the data network is an internet.

74. A method of operating a gaming device, the method comprising the steps of:

(a) displaying a primary game to a player, wherein the primary game is operable upon a wager made by the player;

(b) initiating a secondary game upon an occurrence of a triggering event in the primary game;

(c) displaying a plurality of members in a holding device defining a plurality of first receptacles;

(d) enabling a player to independently select members to release from the first receptacles to engage a plurality of second receptacles;

(e) enabling the player to independently select particular members in the second receptacles in the matrix for a number of activations;

(f) ejecting the selected members from the second receptacles;

(g) providing an award to the player if at least one winning combination of first or second members occurs in the second receptacles after the selected members re-engage the second receptacles; and (h) repeating steps (e) to (g) until at least one winning combination of first or second members occurs in the second receptacles or until there are no ejections remaining.

75. The method of claim 74, wherein the gaming device is operated through a data network.

76. The method of claim 75, wherein the data network is an internet.

* * * * *